US011332917B2

(12) United States Patent
Kitaura et al.

(10) Patent No.: US 11,332,917 B2
(45) Date of Patent: May 17, 2022

(54) FLUSH WATER TANK APPARATUS AND FLUSH TOILET APPARATUS PROVIDED WITH THE SAME

(71) Applicant: TOTO LTD., Kitakyushu (JP)

(72) Inventors: Hidekazu Kitaura, Kitakyushu (JP); Nobuhiro Hayashi, Kitakyushu (JP); Akihiro Shimuta, Kitakyushu (JP); Masahiro Kuroishi, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 17/212,872

(22) Filed: Mar. 25, 2021

(65) Prior Publication Data

US 2021/0270023 A1 Sep. 2, 2021

Related U.S. Application Data

(63) Continuation of application No. PCT/JP2021/003949, filed on Feb. 3, 2021.

(30) Foreign Application Priority Data

Feb. 28, 2020 (JP) ..... JP2020-033606
Feb. 28, 2020 (JP) ..... JP2020-033608

(51) Int. Cl.
*E03D 5/01* (2006.01)
*E03D 5/10* (2006.01)

(52) U.S. Cl.
CPC ..... *E03D 5/01* (2013.01); *E03D 5/10* (2013.01); *E03D 2201/30* (2013.01)

(58) Field of Classification Search
USPC ..... 4/331, 332, 415
See application file for complete search history.

(56) References Cited

U.S. PATENT DOCUMENTS 7,617,949 B2 * 11/2009 Johnson ..... F16K 17/34 137/12

FOREIGN PATENT DOCUMENTS

JP 2009-257061 A 11/2009

* cited by examiner

*Primary Examiner* — Christine J Skubinna
(74) *Attorney, Agent, or Firm* — Studebaker & Brackett PC

(57) ABSTRACT

The flush water tank apparatus of the present invention includes: a clutch mechanism 30 coupling the discharge valve 12 and the discharge valve hydraulic drive unit 14 to pull up the discharge valve, and being disconnected at a predetermined timing to cause the discharge valve to descend; flush water amount selection device capable of selecting from a first and a second amounts of flush water; a float device 26 including a float and a holding mechanism switchable between a holding and a non-holding states in conjunction with movement of the float; and a timing control mechanism controlling a timing of a drain port 10*a* being blocked; and, when the second amount is selected, causes the second amount of flush water to be discharged by switching the holding mechanism to the non-holding state before a water level in a storage tank drops to a predetermined water level.

20 Claims, 18 Drawing Sheets

FLUSH WATER TANK APPARATUS AND FLUSH TOILET APPARATUS PROVIDED WITH THE SAME

BACKGROUND OF THE INVENTION

Field of the Invention

The present invention relates to a flush water tank apparatus and, in particular, to a flush water tank apparatus that supplies flush water to a flush toilet, and a flush toilet apparatus provided with the flush water tank apparatus.

Description of the Related Art

In Japanese Patent Laid-Open No. 2009-257061, a low tank apparatus is described. In this low tank apparatus, a hydraulic cylinder device having a piston and a drain unit is arranged inside a low tank provided with a discharge valve, and the piston and the discharge valve are coupled via a coupling unit. At the time of discharging flush water in the low tank, water is supplied to the hydraulic cylinder device by opening a solenoid value, and the piston is pushed up. Since the piston is connected to the discharge valve via the coupling unit, the discharge valve is pulled up by movement of the piston, the discharge valve is opened, and the flush water in the low tank is discharged. The water supplied to the hydraulic cylinder device flows out from the drain unit and flows into the low tank.

Furthermore, in the case of causing the discharge valve to be closed, supply of water to the hydraulic cylinder device is stopped by causing the solenoid valve to be closed. Thereby, the pushed-up piston descends, and, accompanying this, the solenoid valve returns to a valve closed position due to its own weight. At this time, since the water in the hydraulic cylinder device flows out from the drain unit little by little, the piston slowly descends, and the discharge valve gradually returns to the valve closed position. Further, in the low tank apparatus described in Japanese Patent Laid-Open No. 2009-257061, a time during which the discharge valve is opened is changed by adjusting a time during which the solenoid valve is open, and, thereby, washings with different amounts of flush water, such as large washing and small washing, are realized.

The low tank apparatus described in Japanese Patent Laid-Open No. 2009-257061, however, has a problem that it is difficult to accurately set the amount of flush water to be discharged. In other words, since water in the hydraulic cylinder device flows out from the drain unit little by little after the solenoid valve is closed to cause the discharge valve to be closed, in the low tank apparatus described in Japanese Patent Laid-Open No. 2009-257061, descent of the piston is gradual, and it is difficult to set the time during which the discharge valve is open short. Further, since the descent speed of the piston is dependent on the outflow rate of the water from the drain unit and sliding resistance of the piston, there is a possibility that variation occurs, and there is a possibility that change over time occurs. Therefore, it is difficult to accurately set the amount of flush water to be discharged, in the low tank apparatus described in Japanese Patent Laid-Open No. 2009-257061.

Therefore, an object of the present invention is to provide a flush water tank apparatus capable of accurately setting the amount of flush water to be discharged while opening the discharge valve using water pressure of supplied water, and a flush toilet apparatus provided with the flush water tank apparatus.

SUMMARY OF THE INVENTION

In order to solve the problem described above, an embodiment of the present invention is a flush water tank apparatus for supplying flush water to a flush toilet, the flush water tank apparatus including: a storage tank storing flush water to be supplied to the flush toilet, with a drain port for discharging the stored flush water to the flush toilet formed therein; a discharge valve opening/closing the drain port and performing supply/stop of the flush water to the flush toilet; a discharge valve hydraulic drive unit driving the discharge valve using water supply pressure of supplied tap water; a clutch mechanism coupling the discharge valve and the discharge valve hydraulic drive unit to pull up the discharge valve by driving force of the discharge valve hydraulic drive unit, and being disconnected at a predetermined timing to cause the discharge valve to descend; a flush water amount selection device capable of selecting between a first amount of flush water for washing the flush toilet and a second amount of flush water smaller than the first amount of flush water; and a timing control mechanism controlling, when the second amount of flush water is selected by the flush water amount selection device, a timing of causing the discharge valve to descend so that a timing of the drain port being blocked is earlier than a case of the first amount of flush water being selected.

According to the present invention configured as described above, since the discharge valve and the discharge valve hydraulic drive unit are coupled by the clutch mechanism and disconnected at the predetermined timing, it becomes possible to cause the discharge valve to move regardless of the operation speed of the discharge valve hydraulic drive unit and cause the discharge valve to be closed. Thereby, it becomes possible to, even if the operation speed of the discharge valve hydraulic drive unit varies at the time of causing the discharge valve to descend, control the timing of causing the discharge valve to be closed without being influenced by the variation. Further, when the second amount of flush water is selected by the flush water amount selection device, the timing of causing the discharge valve to descend can be controlled by the timing control mechanism so that the timing of the drain port being blocked is earlier than the case of the first amount of flush water being selected. Therefore, according to the present invention, it is possible to set the first or second amount of flush water using the clutch mechanism.

According to the present invention, it is possible to provide a flush water tank apparatus capable of accurately setting the amount of flush water to be discharged while opening a discharge valve by a discharge valve hydraulic drive unit, and a flush toilet apparatus provided with the flush water tank apparatus.

DETAILED DESCRIPTION OF THE PREFERRED EMBODIMENTS

Next, a flush toilet apparatus according to a first embodiment will be described with reference to accompanying drawings.

Figure 1:
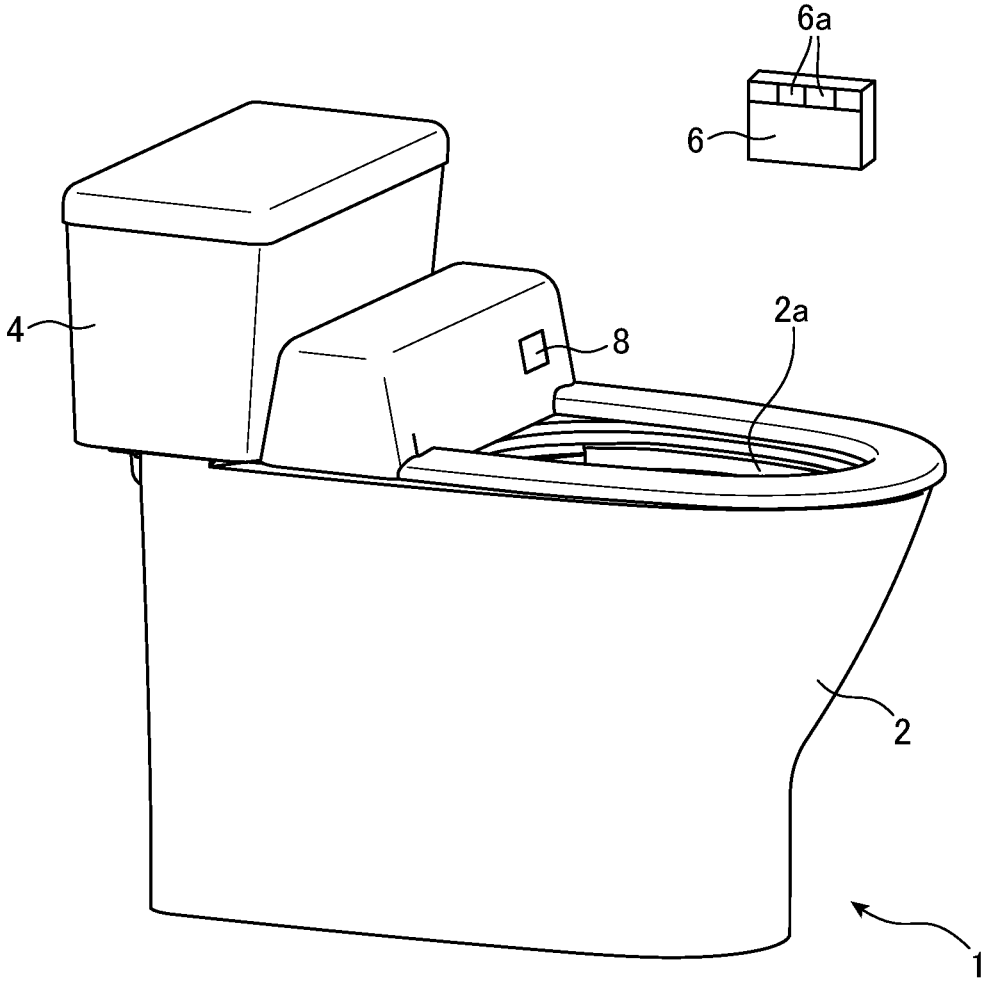
FIG. 1 is a perspective view showing an overall flush toilet apparatus provided with a flush water tank apparatus according to a first embodiment of the present invention.
Figure 2:
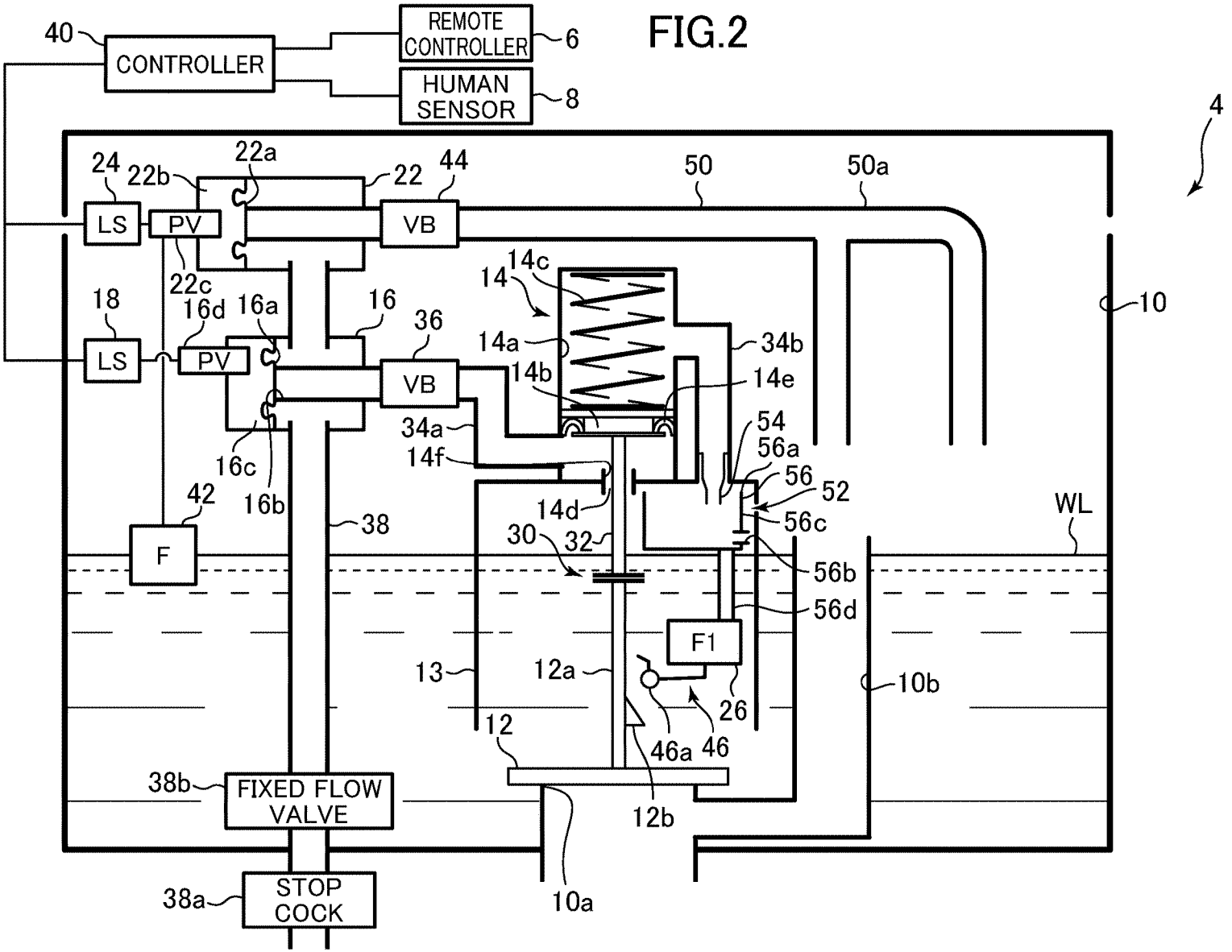
FIG. 2 is a sectional view showing a schematic configuration of the flush water tank apparatus according to the first embodiment of the present invention.

FIG. 1 is a perspective view showing an overall flush toilet apparatus provided with a flush water tank apparatus according to a first embodiment of the present invention. FIG. 2 is a sectional view showing a schematic configuration of the flush water tank apparatus according to the first embodiment of the present invention.

As shown in FIG. 1, a flush toilet apparatus 1 according to the first embodiment of the present invention is configured with a flush toilet main body 2, which is a flush toilet, and a flush water tank apparatus 4 according to the first embodiment of the present invention, which is placed at the back of the flush toilet main body 2. The flush toilet main body 2 is washed by flush water supplied from the flush water tank apparatus 4. The flush toilet apparatus 1 of the present embodiment is configured so that washing of a bowl 2*a* of the flush toilet main body 2 is performed by a remote controller 6 attached to a wall surface being operated after use or by a predetermined time having passed after a human sensor 8 provided on a toilet seat detecting a user leaving the toilet seat. The flush water tank apparatus 4 according to the present embodiment is configured to discharge flush water stored inside to the flush toilet main body 2 based on an instruction signal from the remote controller 6 or the human sensor 8 and wash the bowl 2*a* by the flush water.

Further, "large washing" or "small washing" for washing the bowl 2*a* is executed by the user pressing a push button 6*a* on the remote controller 6. Therefore, in the present embodiment, the remote controller 6 functions as flush water amount selection device capable of selecting between a first amount of flush water for washing the flush toilet main body 2 and a second amount of flush water smaller than the first amount of flush water. Note that, though the human sensor 8 is provided on the toilet seat in the present embodiment, the present invention is not limited to this form. The human sensor 8 is only required to be provided at a position where it is possible to detect the user's motions of sitting on, standing from, approach to and leaving from the toilet seat, and holding his hand. For example, the human sensor 8 may be provided on the flush toilet main body 2 or the flush water tank apparatus 4. Further, the human sensor 8 may be anything that can detect the user's motions of sitting on, standing from, approach to and leaving from the toilet seat, and holding his hand, and, for example, an infrared sensor or a microwave sensor can be used as the human sensor 8. Further, the remote controller 6 may be changed to an operation lever device or an operation button device having such a structure that is capable of mechanically controlling opening/closing of a first control valve 16 and a second control valve 22 described later.

As shown in FIG. 2, the flush water tank apparatus 4 has a storage tank 10 for storing flush water to be supplied to the flush toilet main body 2, a discharge valve 12 for opening/closing a drain port 10*a* provided on the storage tank 10, and a discharge valve hydraulic drive unit 14 that drives the discharge valve 12. Further, the flush water tank apparatus 4 has the first control valve 16 that controls water supply to the discharge valve hydraulic drive unit 14 and a solenoid valve 18 attached to the first control valve 16 inside the storage tank 10. Furthermore, the flush water tank apparatus 4 has the second control valve 22 for supplying flush water to the storage tank 10 and a solenoid valve 24 attached to the second control valve 22 inside the storage tank 10. Further, the flush water tank apparatus 4 has a clutch mechanism 30, and the clutch mechanism 30 couples the discharge valve 12 and the discharge valve hydraulic drive unit 14 to pull up the discharge valve 12 by driving force of the discharge valve hydraulic drive unit 14. Furthermore, the flush water tank apparatus 4 has a float device 26 for holding the discharge valve 12 that has descended by the clutch mechanism 30 being disconnected, at a predetermined position. Further, the flush water tank apparatus 4 is provided with a water storage device 52 as a timing control mechanism for controlling a timing of the discharge valve 12 descending and the drain port 10*a* being blocked.

The storage tank 10 is a tank configured to store flush water to be supplied to the flush toilet main body 2, and the drain port 10*a* for discharging the stored flush water to the flush toilet main body 2 is formed on a bottom portion of the storage tank 10. Inside the storage tank 10, an overflow pipe 10*b* is connected to the downstream side of the drain port 10*a*. The overflow pipe 10*b* vertically rises from near the drain port 10*a* and extends above a full water level WL of the flush water stored in the storage tank 10. Therefore, flush water that has flowed in from the upper end of the overflow pipe 10*b* bypasses the drain port 10*a* and flows out directly to the flush toilet main body 2.

The discharge valve 12 is a valve body arranged so as to open/close the drain port 10*a*. The discharge valve 12 is opened by being pulled upward, and flush water in the storage tank 10 is discharged to the flush toilet main body 2, so that the bowl 2*a* is washed. The discharge valve 12 is pulled up by driving force of the discharge valve hydraulic drive unit 14. When the discharge valve 12 is pulled up to a predetermined height, the clutch mechanism 30 is disconnected, and the discharge valve 12 descends due to its own weight. When the discharge valve 12 descends, the discharge valve 12 is held at a predetermined position for a predetermined time by the float device 26. Further, above the discharge valve 12, a casing 13 is formed. The casing 13 is formed in a cylindrical shape with its lower side open. The casing 13 is connected and fixed to the discharge valve hydraulic drive unit 14 and a discharge unit 54 that discharges flush water to the water storage device 52.

The discharge valve hydraulic drive unit 14 is configured to utilize water supply pressure of flush water supplied from a tap water pipe to drive the discharge valve 12. Specifically, the discharge valve hydraulic drive unit 14 has a cylinder 14*a* into which flush water supplied from the first control valve 16 flows, a piston 14*b* slidably arranged in the cylinder 14*a*, and a rod 32 that projects from the lower end of the cylinder 14*a* to drive the discharge valve 12.

Furthermore, a spring 14*c* is arranged inside the cylinder 14*a* and energizes the piston 14*b* downward. A packing 14*e* is attached to the piston 14*b* so that watertightness between the inner wall surface of the cylinder 14*a* and the piston 14*b* is ensured. Furthermore, the clutch mechanism 30 is provided at the lower end of the rod 32, and the rod 32 and a valve stem 12*a* of the discharge valve 12 are coupled/released by the clutch mechanism 30.

The cylinder 14*a* is a cylindrical-shaped member, which is arranged with its axis in the vertical direction and accepts the piston 14*b* inside in a slidable state. A drive unit water supply passage 34*a* is connected to a lower end portion of the cylinder 14*a* so that flush water flowing out of the first control valve 16 flows into the cylinder 14*a*. Therefore, the piston 14*b* in the cylinder 14*a* is pushed up against energizing force of the spring 14*c* by the flush water flowing into the cylinder 14*a*.

On an upper part of the cylinder 14*a*, an outflow hole is provided, and a drive unit discharge passage 34*b* communicates with the inside of the cylinder 14*a* via the outflow hole. Therefore, when flush water flows into the cylinder 14*a* from the drive unit water supply passage 34*a* connected to a lower part of the cylinder 14*a*, the piston 14*b* is pushed upward from the lower part of the cylinder 14*a* which is a first position. Then, when the piston 14*b* is pushed up to a second position above the outflow hole, the water that flowed into the cylinder 14*a* flows through the drive unit discharge passage 34*b* from the outflow hole. In other words, when the piston 14*b* is moved to the second position, the drive unit water supply passage 34*a* and the drive unit discharge passage 34*b* are caused to communicate with each other via the inside of the cylinder 14*a*. At a distal end portion of the drive unit discharge passage 34*b* extending from the cylinder 14*a*, a discharge unit 54 that discharges flush water to the water storage device 52 is formed. As described above, the drive unit discharge passage 34*b* forms a flow channel extending up to the discharge unit 54.

The rod 32 is a rod-shaped member connected to the lower surface of the piston 14*b*. The rod 32 passes through a through hole 14*f* formed in the bottom surface of the cylinder 14*a* and extends in a manner of projecting downward from inside the cylinder 14*a*. Between the rod 32 projecting downward from the cylinder 14*a* and the inner wall of the through hole 14*f* of the cylinder 14*a*, a gap 14*d* is provided, and a part of flush water flowing into the cylinder 14*a* flows out from the gap 14*d*. The water flowing out from the gap 14*d* flows into the storage tank 10. Note that, since the gap 14*d* is relatively narrow, and flow channel resistance is large, pressure inside the cylinder 14*a* increases due to the flush water flowing into the cylinder 14*a* from the drive unit water supply passage 34*a* even in the state of water flowing out from the gap 14*d*, and the piston 14*b* is pushed up, being against the energizing force of the spring 14*c*.

Next, the first control valve 16 controls supply/stop of flush water to the discharge valve hydraulic drive unit 14 based on operation of the solenoid valve 18. Further, on the downstream side of the discharge valve hydraulic drive unit 14, the water storage device 52 is provided, and flush water that has passed through the discharge valve hydraulic drive unit 14 is supplied to the water storage device 52. Therefore, supply/stop of flush water to the water storage device 52 is also controlled by the first control valve 16. That is to say, the first control valve 16 is provided with a main valve body 16*a*, a main valve port 16*b* opened/closed by the main valve body 16*a*, a pressure chamber 16*c* for causing the main valve body 16*a* to move, and a pilot valve 16*d* for switching pressure in the pressure chamber 16*c*.

The main valve body 16*a* is configured so as to open/close the main valve port 16*b* of the first control valve 16. When the main valve port 16*b* is opened, tap water supplied from a water supply pipe 38 flows into the discharge valve hydraulic drive unit 14. The pressure chamber 16*c* is provided adjacent to the main valve body 16*a* in a case of the first control valve 16. The pressure chamber 16*c* is configured so that a part of the tap water supplied from the water supply pipe 38 flows in so that internal pressure increases. When the pressure in the pressure chamber 16*c* increases, the main valve body 16*a* is moved toward the main valve port 16*b*, and the main valve port 16*b* is closed.

The pilot valve 16*d* is configured to open/close a pilot valve port (not shown) provided for the pressure chamber 16*c*. When the pilot valve port (not shown) is opened by the pilot valve 16*d*, water in the pressure chamber 16*c* flows out, and the internal pressure decreases. When the pressure in the pressure chamber 16*c* decreases, the main valve body 16*a* leaves from the main valve port 16*b*, and the first control valve 16 is opened. When the pilot valve 16*d* is closed, the pressure in the pressure chamber 16*c* increases, and the first control valve 16 is closed.

The pilot valve 16*d* is moved by the solenoid valve 18 attached to the pilot valve 16*d* to open/close the pilot valve port (not shown). The solenoid valve 18 is electrically connected to a controller 40 and causes the pilot valve 16*d* to move, based on a command signal from the controller 40. Specifically, the controller 40 receives a signal from the remote controller 6 or the human sensor 8 and sends an electrical signal to the solenoid valve 18 to cause the solenoid valve 18 to operate.

Further, the drive unit water supply passage 34*a* between the first control valve 16 and the discharge valve hydraulic drive unit 14 is provided with a vacuum breaker 36. When negative pressure occurs on the first control valve 16 side, backflow of water to the first control valve 16 side is prevented by the vacuum breaker 36.

The second control valve 22 is configured to control supply/stop of flush water to the storage tank 10 based on operation of the solenoid valve 24. Though the second control valve 22 is connected to the water supply pipe 38 via the first control valve 16, tap water supplied from the water supply pipe 38 always flows into the second control valve 22 irrespective of whether the first control valve 16 is open or closed. The second control valve 22 is provided with a main valve body 22*a*, a pressure chamber 22*b* and a pilot valve 22*c*, and the pilot valve 22*c* is opened/closed by the solenoid valve 24. When the pilot valve 22*c* is opened by the solenoid valve 24, the main valve body 22*a* of the second control valve 22 is opened, and tap water flowing in from the water supply pipe 38 is supplied into the storage tank 10 or to the overflow pipe 10*b*. Further, the solenoid valve 24 is electrically connected to the controller 40 and causes the pilot valve 22*c* to move, based on a command signal from the controller 40. Specifically, the controller 40 sends an electrical signal to the solenoid valve 24 based on an operation of the remote controller 6 to cause the solenoid valve 24 to operate.

A float switch 42 is connected to the pilot valve 22*c*. The float switch 42 is configured to control the pilot valve 22*c* based on a water level in the storage tank 10 to open/close a pilot valve port (not shown). In other words, when the water level in the storage tank 10 reaches a predetermined water level, the float switch 42 sends a signal to the pilot valve 22*c* to cause the pilot valve port (not shown) to be closed. In other words, the float switch 42 is configured to set the water storage level in the storage tank 10 to the predetermined full water level WL which is a stopped water level. The float switch 42 is arranged in the storage tank 10 and is configured to, when the water level of the storage tank 10 increases to the full water level WL, stop water supply from the first control valve 16 to the discharge valve hydraulic drive unit 14. Note that, though the solenoid valve 24 is controlled based on a detection signal of the float switch 42 to open/close the pilot valve 22*c* in the present embodiment, the solenoid valve 24 can be omitted. In other words, the present invention can be configured so that the pilot valve 22*c* is mechanically opened/closed using a float that goes up and down based on the water level in the storage tank 10.

A water supply passage 50 extending from the second control valve 22 is provided with a water supply passage branch portion 50*a*. One of branched water supply passages 50 is configured to cause water to flow out into the storage tank 10, and the other is configured to cause water to flow out into the overflow pipe 10*b*. Therefore, a part of flush water supplied from the second control valve 22 is discharged into the flush toilet main body 2 through the overflow pipe 10*b*, and the remaining flush water is stored in the storage tank 10.

Further, the water supply passage 50 is provided with a vacuum breaker 44. When negative pressure occurs on the second control valve 22 side, backflow of water to the second control valve 22 side is prevented by the vacuum breaker 44.

Water supplied from the tap water pipe is supplied to each of the first control valve 16 and the second control valve 22 via a stop cock 38*a* arranged outside the storage tank 10 and a fixed flow valve 38*b* arranged in the storage tank 10 on the downstream side of the stop cock 38*a*. The stop cock 38*a* is provided to stop supply of water to the flush water tank apparatus 4 at the time of maintenance and the like, and is usually used in an open state. The fixed flow valve 38*b* is provided so as to cause water supplied from the tap water pipe to flow into the first control valve 16 and the second control valve 22 at a predetermined flow rate, and is configured so that water at a certain flow rate is supplied regardless of the installation environment of the flush toilet apparatus 1.

The controller 40 includes a CPU, a memory and the like and controls connected equipment to execute a large washing mode or a small washing mode described later, based on a predetermined control program recorded in the memory or the like. The controller 40 is electrically connected to the remote controller 6, the human sensor 8, the solenoid valve 18, the solenoid valve 24 and the like.

Next, a configuration and operation of the clutch mechanism 30 will be described, newly referring to FIGS. 3A-3H.

FIGS. 3A-3H schematically shows the configuration of the clutch mechanism 30 and shows operation at the time of being pulled up by the discharge valve hydraulic drive unit 14.

Figure 3A:
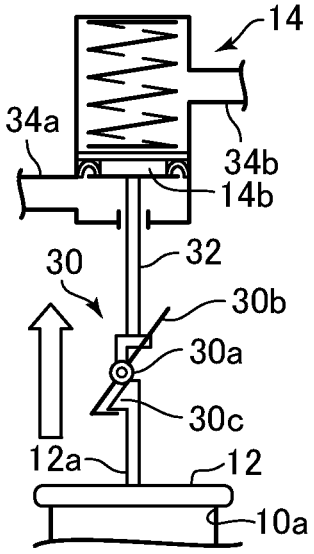
FIG. 3A is a diagram schematically showing a configuration and operation of a clutch mechanism provided in the flush water tank apparatus according to the first embodiment of the present invention.

First, as shown in FIG. 3A, the clutch mechanism 30 is provided at the lower end of the rod 32 extending downward from the discharge valve hydraulic drive unit 14, and is configured so as to couple/release the lower end of the rod 32 and the upper end of the valve stem 12*a* of the discharge valve 12. The clutch mechanism 30 has a rotary shaft 30*a* attached to the lower end of the rod 32, a hook member 30*b* supported by the rotary shaft 30*a*, and an engaging claw 30*c* provided at the upper end of the valve stem 12*a*. Due to such a structure, the clutch mechanism 30 is adapted to be disconnected at a predetermined timing and at a predetermined pull-up height to cause the discharge valve 12 to descend.

The rotary shaft 30*a* is attached at the lower end of the rod 32 in the horizontal direction and supports the hook member 30*b* in a rotatable state. The hook member 30*b* is a plate-shaped member, and an intermediate part of the hook member 30*b* is rotatably supported by the rotary shaft 30*a*. The lower end of the hook member 30*b* is bent in a hook shape to form a hook portion. The engaging claw 30*c* provided on the upper end of the valve stem 12*a* of the discharge valve 12 is a claw in a right-angle triangular shape. The base of the engaging claw 30*c* is almost in the horizontal direction, and the side face is formed to be sloped downward.

In the state shown in FIG. 3A, the discharge valve 12 seats on the drain port 10*a*, and the drain port 10*a* is blocked. In this state, the discharge valve hydraulic drive unit 14 and the discharge valve 12 are coupled. In this coupled state, the claw portion of the hook member 30*b* is engaged with the base of the engaging claw 30*c*, and the discharge valve 12 can be pulled up by the rod 32.

Figure 3B:
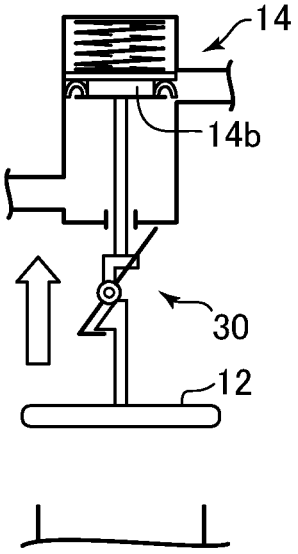
FIG. 3B is a diagram schematically showing a configuration and operation of a clutch mechanism provided in the flush water tank apparatus according to the first embodiment of the present invention.
Figure 3C:
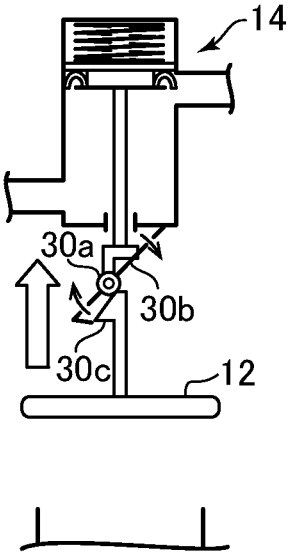
FIG. 3C is a diagram schematically showing a configuration and operation of a clutch mechanism provided in the flush water tank apparatus according to the first embodiment of the present invention.
Figure 3D:
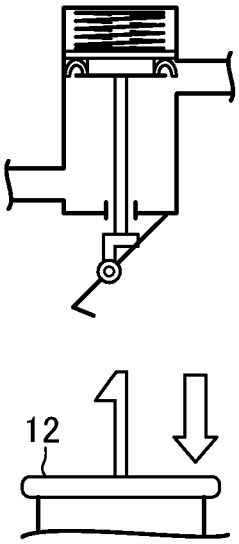
FIG. 3D is a diagram schematically showing a configuration and operation of a clutch mechanism provided in the flush water tank apparatus according to the first embodiment of the present invention.

Next, as shown in FIG. 3B, when flush water is supplied to the discharge valve hydraulic drive unit 14, the piston 14*b* moves upward, and, accordingly, the discharge valve 12 is pulled up by the rod 32. Furthermore, as shown in FIG. 3C, when the discharge valve 12 is pulled up to a predetermined position, the upper end of the hook member 30*b* comes into contact with the bottom surface of the discharge valve hydraulic drive unit 14, and the hook member 30*b* is rotated around the rotary shaft 30*a*. By this rotation, the claw portion at the lower end of the hook member 30*b* is moved in a direction of disengaging from the engaging claw 30*c*, and engagement between the hook member 30*b* and the engaging claw 30*c* is released. When the engagement between the hook member 30*b* and the engaging claw 30*c* is released, the discharge valve 12 descends toward the drain port 10*a* in flush water stored in the storage tank 10 as shown in FIG. 3D. (Note that, as described later, the descended discharge valve 12 is temporarily held at a predetermined height by the float device 26 before seating on the drain port 10*a*.)

Figure 3E:
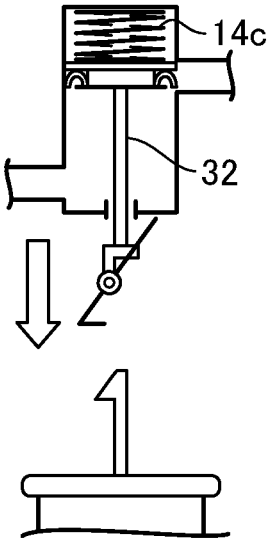
FIG. 3E is a diagram schematically showing a configuration and operation of a clutch mechanism provided in the flush water tank apparatus according to the first embodiment of the present invention.
Figure 3F:
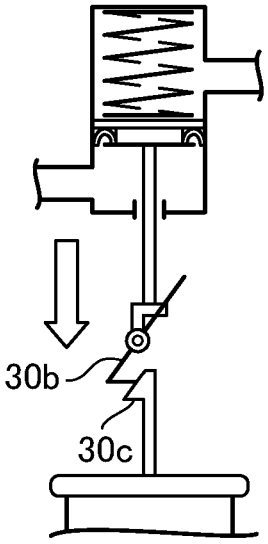
FIG. 3F is a diagram schematically showing a configuration and operation of a clutch mechanism provided in the flush water tank apparatus according to the first embodiment of the present invention.
Figure 3G:
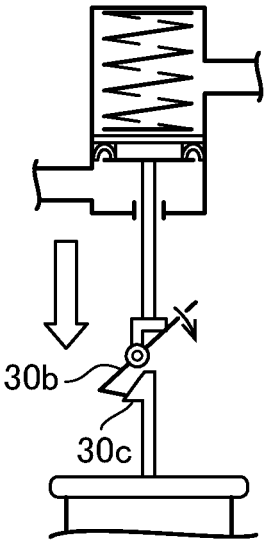
FIG. 3G is a diagram schematically showing a configuration and operation of a clutch mechanism provided in the flush water tank apparatus according to the first embodiment of the present invention.
Figure 3H:
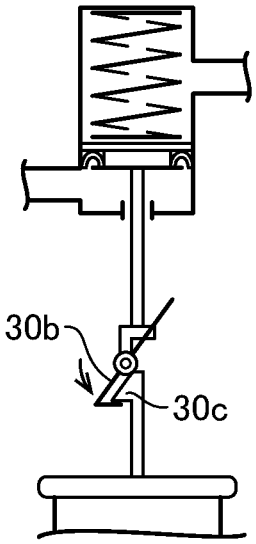
FIG. 3H is a diagram schematically showing a configuration and operation of a clutch mechanism provided in the flush water tank apparatus according to the first embodiment of the present invention.

Furthermore, as shown in FIG. 3E, when flush water supplied to the discharge valve hydraulic drive unit 14 is stopped, the rod 32 descends due to the energizing force of the spring 14*c*. When the rod 32 descends, the distal end of the hook member 30*b* attached to the lower end of the rod 32 comes into contact with the engaging claw 30*c* as shown in FIG. 3F. When the rod 32 descends more, the claw portion of the hook member 30*b* is pushed by the sloped surface of the engaging claw 30*c* as shown in FIG. 3G, and the hook member 30*b* is rotated. When the rod 32 descends more, the claw portion of the hook member 30*b* gets over the engaging claw 30*c*, the hook member 30*b* is rotated to the original position by the gravity, and the claw portion of the hook member 30*b* and the engaging claw 30*c* engage with each other again as shown in FIG. 3H and return to the state shown in FIG. 3A.

Figure 4A:
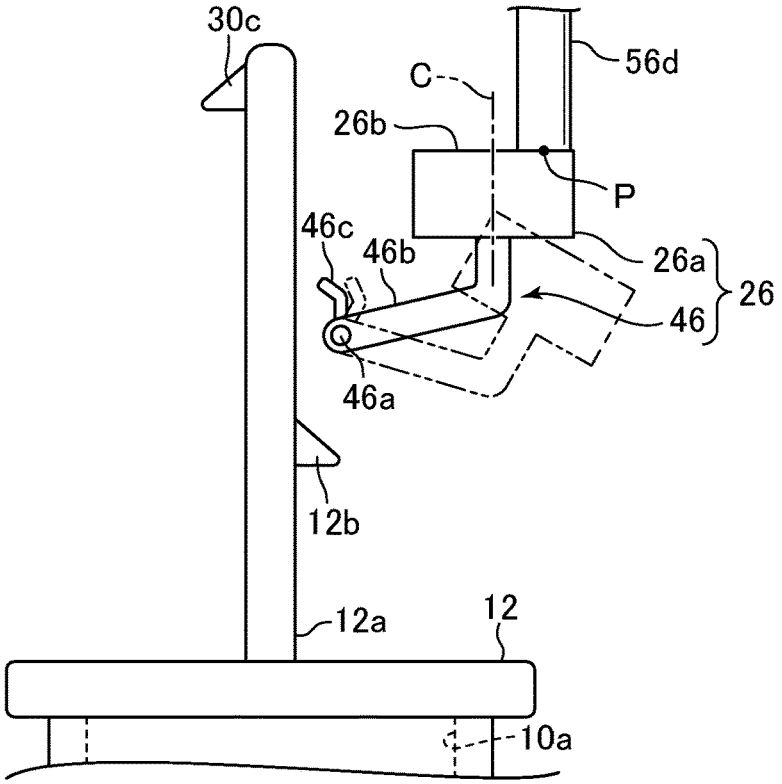
FIG. 4A is a diagram enlargingly showing a portion of a discharge valve and a float device provided for the flush water tank apparatus according to the first embodiment of the present invention.
Figure 4B:
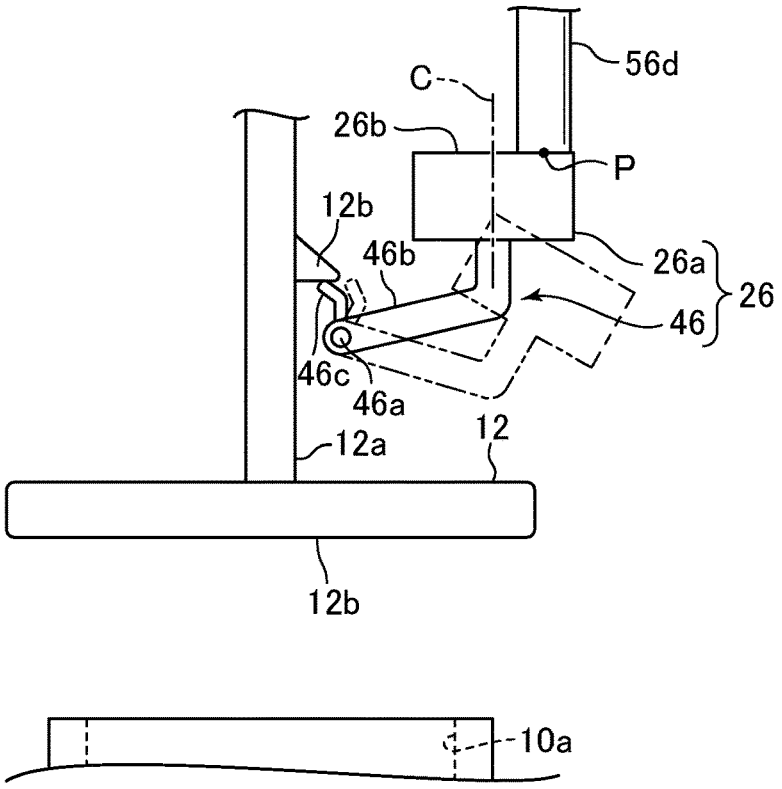
FIG. 4B is a diagram enlargingly showing a portion of a discharge valve and a float device provided for the flush water tank apparatus according to the first embodiment of the present invention.

Next, a configuration and operation of the float device 26 will be described, newly referring to FIGS. 4A-4B. FIGS. 4A-4B is a diagram enlargingly showing the portion of the discharge valve 12 and the float device 26 in FIG. 2. A state in which the discharge valve 12 is closed is shown in FIG. 4A, and a state in which the discharge valve 12 is open and held by the float device 26 is shown in FIG. 4B.

As shown in FIGS. 4A-4B, the float device 26 has a float 26*a* that is moved according to the water level in the storage tank 10 and a holding mechanism 46 that supports the float 26*a* in a rotatable state.

The float 26*a* is a hollow rectangular parallelepiped member and is configured to receive buoyancy from flush water stored in the storage tank 10. When the water level in the storage tank 10 is a predetermined water level (approximately the water level of the float 26*a*) or above, the float 26*a* is in the state shown by solid lines in FIG. 4A due to the buoyancy.

The holding mechanism 46 is moved between a holding state and a non-holding state in conjunction with movement of the float 26*a*. The holding mechanism 46 is configured to, when moved to the holding state, engage with the discharge valve 12 to hold the discharge valve 12 at a predetermined height. The holding mechanism 46 is a mechanism that supports the float 26*a* in a rotatable state and has a support shaft 46*a*, and an arm member 46*b* and an engaging member 46*c* supported by the support shaft 46*a*. The support shaft 46*a* is a rotary shaft fixed to the storage tank 10 by an arbitrary member (not shown) and supports the arm member 46*b* and the engaging member 46*c* in a rotatable state. At a proximal end portion of the valve stem 12*a* of the discharge valve 12, a holding claw 12*b* formed to be engageable with the engaging member 46*c* is formed. The holding claw 12*b* is a projection in a right-angle triangular shape, which extends toward the engaging member 46*c* from the proximal end portion of the valve stem 12*a*. Its base is in the horizontal direction, and its side face is formed to be sloped downward.

The support shaft 46*a* is a shaft extending in a direction orthogonal to the surface of FIGS. 4A-4B. Both of its end portions are fixed to the storage tank 10 by an arbitrary member (not shown), and an intermediate part is formed being curved to be away from the valve stem 12*a*. The arm member 46*b* is a beam-shaped member that is bent, and its lower end portion is configured to branch into two. These branched lower ends of the arm member 46*b* are rotatably supported by both end portions of the support shaft 46*a*, respectively. Therefore, even when the discharge valve 12 is moved in the vertical direction, it does not happen that the support shaft 46*a* and the arm member 46*b* interfere with the holding claw 12*b* provided on the valve stem 12*a* of the discharge valve 12.

An upper end portion of the arm member 46*b* is fixed to the bottom surface of the float 26*a*. Therefore, in a state of receiving buoyancy, the float 26*a* is held in the state shown by the solid lines in FIG. 4A. When the water level in the storage tank 10 drops, the float 26*a* and the arm member 46*b* are rotated around the support shaft 46*a* due to their own weights up to a state shown by imaginary lines in FIG. 4A. Note that the rotation of the float 26*a* and the arm member 46*b* is restricted to a range between the holding state of the holding mechanism 46 shown by the solid lines in FIG. 4A and the non-holding state shown by the imaginary lines.

Furthermore, the engaging member 46*c* is a member rotatably attached to the support shaft 46*a*, and its proximal end portion is rotatably supported by both end portions of the support shaft 46*a*. A distal end portion of the engaging member 46*c* curvedly extends towards the valve stem 12*a* of the discharge valve 12. Therefore, in the holding state of having been rotated to the position shown by the solid lines of FIG. 4A, the distal end portion of the engaging member 46*c* interferes with the holding claw 12*b* provided on the valve stem 12*a*. In comparison, in the non-holding state of having been rotated to the position shown by the imaginary lines of FIG. 4A, interference between the distal end portion of the engaging member 46*c* and the holding claw 12*b* does not occur.

The engaging member 46*c* is configured to be rotated around the support shaft 46*a* in conjunction with the arm member 46*b*. In other words, when the float 26*a* and the arm member 46*b* are rotated from the state shown by the solid lines in FIG. 4A to the state shown by the imaginary lines, the engaging member 46*c* is also rotated to the state shown by the imaginary lines in conjunction with the arm member 46*b*. However, if the distal end of the engaging member 46*c* is pushed upward by the holding claw 12*b* of the discharge valve 12 in the state shown by the solid lines in FIG. 4A, only the engaging member 46*c* can rotate idle. In other words, when the distal end portion of the engaging member 46*c* is pushed upward by the holding claw 12*b*, only the engaging member 46*c* can rotate to the position shown by the imaginary lines of FIGS. 4A-4B while the float 26*a* and the arm member 46*b* keep holding the position shown by the solid lines.

In a state in which the discharge valve 12 is pulled upward, and the holding claw 12*b* is positioned above the engaging member 46*c* as shown by solid lines in FIG. 4B, the holding claw 12*b* and the engaging member 46*c* engage with each other, and descent of the discharge valve 12 is prevented. In other words, the engaging member 46*c* constituting the holding mechanism 46 engages with the discharge valve 12 and holds the discharge valve 12 at a predetermined height. Therefore, the discharge valve 12 is pulled up by the rod 32 (FIGS. 3A-3H) connected to the discharge valve hydraulic drive unit 14, and, after that, the discharge valve 12 descends when the clutch mechanism 30 is disconnected. The holding claw 12*b* of the discharge valve 12 and the engaging member 46*c* of the holding mechanism 46 engage with each other during the descent, and the discharge valve 12 is held at the predetermined height.

Then, when the water level in the storage tank 10 drops to a predetermined water level, the position of the float 26*a* descends, and the float 26*a* and the arm member 46*b* rotate to the position shown by imaginary lines in FIG. 4B. Since the engaging member 46*c* is also rotated to the position shown by the imaginary lines in FIG. 4B in conjunction with this rotation, the engagement between the holding claw 12*b* and the engaging member 46*c* is released. Thereby, the discharge valve 12 descends and seats on the drain port 10*a*, and the drain port 10*a* is blocked.

Next, a description will be made on the water storage device 52 which is a timing control mechanism according to the first embodiment of the present invention, with reference to FIGS. 2 and 4.

As described later, the water storage device 52 is configured to, when the second amount of flush water is selected by the remote controller 6 or the like, push down the float 26*a* of the float device 26 and switch the holding mechanism 46 of the float device 26 to the non-holding state before the water level in the storage tank 10 drops to a predetermined water level. Thereby, the timing of the discharge valve 12 descending and the drain port 10*a* being blocked is earlier than the case of the first amount of flush water being selected, and it is possible to cause flush water corresponding to the second amount of flush water smaller than the first amount of flush water to be discharged from the drain port 10*a*.

The water storage device 52 is provided with the discharge unit 54 for discharging supplied flush water and a water storage unit 56 for storing the flush water discharged from the discharge unit 54. As described later, when the second amount of flush water is selected by the remote controller 6 or the like, the water storage device 52 uses flush water supplied from the first control valve 16 to switch the holding mechanism 46 of the float device 26 to the non-holding state. More specifically, the water storage device 52 switches the holding mechanism 46 to the non-holding state by pushing down the float 26*a* of the float device 26 using the weight of the flush water supplied from the first control valve 16. Thereby, the timing of causing the discharge valve 12 to descend is controlled.

The discharge unit 54 is formed at the lower end of the drive unit discharge passage 34*b* and extends downward. The discharge unit 54 forms a tapering and downward discharge port. Therefore, flush water is accelerated downward by the gravity, and its flow velocity is further accelerated because the flow channel is narrowed at the discharge port. The discharge unit 54 is arranged inside the water storage unit 56 and at a height lower than an upper end 56*a*. At least the discharge port at the lower end of the discharge unit 54 is arranged inside the water storage unit 56 and at a height lower than the upper end 56*a*.

The water storage unit 56 is a hollow box-shaped member arranged on the lower side of the discharge unit 54, and the upper surface is open. Thereby, flush water discharged from the discharge unit 54 flows into the water storage unit 56. The capacity of the water storage unit 56 is smaller than the capacity of the cylinder 14*a*. The water storage unit 56 is supported movably in the vertical direction in the storage tank 10 by a support member (not shown). Furthermore, the water storage unit 56 is provided with a rod member 56*d* which is a transmission portion extending downward in the vertical direction from the bottom surface. The rod member 56*d* is formed in a pillar shape and fixed to the bottom surface of the water storage unit 56. Further, the water storage unit 56 is arranged above the float device 26, and the lower end of the rod member 56*d* faces the upper surface 26*b* of the float 26*a*. As shown in FIG. 4A, when the water storage unit 56 is in a standby state (a state in which flush water is not stored in the water storage unit 56), the lower end of the rod member 56*d* is supported above the upper surface of the float 26*a*. Furthermore, in the state in which flush water is not stored inside, the water storage unit 56 is positioned above the stopped water level (the full water level WL) of the storage tank 10.

Furthermore, a discharge hole 56*b* for discharging stored flush water is formed in the water storage unit 56. The discharge hole 56*b* is formed in a lower part of a side wall 56*c* of the water storage unit 56 and forms an opening facing the opposite side of the valve stem 12*a* of the discharge valve 12 in a plan view. The discharge hole 56*b* forms a small hole with a relatively small diameter. Therefore, an instantaneous flow rate A1 (see FIG. 7) of flush water discharged outside the water storage unit 56 (into the storage tank 10) from the discharge hole 56*b* is smaller than an instantaneous flow rate A2 (see FIG. 6) of flush water discharged from the discharge unit 54.

The rod member 56*d* is adapted to transmit the weight of the water storage unit 56 to the float 26*a*. Since flush water is not stored in the water storage unit 56 in the standby state before starting washing, buoyancy that acts on the float 26*a* overcomes the weight of the water storage unit 56, and the water storage unit 56 is positioned at an upper position as shown in FIG. 2. When flush water with a weight more than a predetermined weight is stored in the water storage unit 56, the water storage device 52 causes the rod member 56*d* to operate so that force transmitted by the rod member 56*d* pushes down the float 26*a*. Therefore, an upper surface 26*b* of the float 26*a* functions as a force receiving surface that receives downward force of the rod member 56*d*. By the float 26*a* being moved, being pushed down, the holding mechanism 46 is switched from the holding state shown by the solid lines in FIGS. 4A-4B to the non-holding state shown by the imaginary lines in FIGS. 4A-4B regardless of the water level in the storage tank 10, and the discharge valve 12 descends by engagement with the engaging member 46*c* of the holding mechanism 46 being released.

A contact point P that is the center of action on the upper surface 26*b* by the rod member 56*d* is positioned on a side away from the support shaft 46*a* relative to a center line C of the float 26*a*. Since the rod member 56*d* acts on the side away from the support shaft 46*a* relative to the center line C of the float 26*a* as described above, the moment of force around the support shaft 46*a* that acts by the rod member 56*d* can be increased.

Next, a description will be made on operation of the flush water tank apparatus 4 according to the first embodiment of the present invention and operation of the flush toilet apparatus 1 provided with the flush water tank apparatus 4, newly referring to FIG. 2 and FIGS. 5 to 10.

First, in the toilet washing standby state shown in FIG. 2, the water level in the storage tank 10 is the predetermined full water level WL. In this state, both of the first control valve 16 and the second control valve 22 are closed. The holding mechanism 46 is in the holding state shown by the solid lines in FIG. 4A. Next, when the user pushes a large washing button on the remote controller 6 (FIG. 1), the remote controller 6 transmits an instruction signal for executing the large washing mode to the controller 40 (FIG. 2). When a small washing button is pushed, an instruction signal for executing the small washing mode is transmitted to the controller 40. Thus, in the present embodiment, the flush toilet apparatus 1 is provided with the two washing modes, the large washing mode and the small washing mode with different amounts of flush water, and the remote controller 6 functions as the flush water amount selection device for selecting the amount of flush water. The flush toilet apparatus 1 is provided with the plurality of washing modes with different amounts of flush water.

Note that, in the flush toilet apparatus 1 of the present embodiment, if a predetermined time passes without the washing button on the remote controller 6 not being pressed after it is detected by the human sensor 8 (FIG. 1) that the user has left the toilet seat, an instruction signal for toilet washing is also transmitted to the controller 40. Further, if a time from the user sitting on the toilet seat until leaving the toilet seat is shorter than a predetermined time, the controller 40 judges that the user has urinated and executes the small washing mode. On the other hand, if the time from sitting on the toilet seat until leaving the toilet seat is longer than the predetermined time, the controller 40 executes the large washing mode. Therefore, in this case, since the large washing mode for performing washing with the first amount of flush water or the small washing mode for performing washing with the second amount of flush water is selected by the controller 40, the controller 40 functions as the flush water amount selection device.

Next, operation of the large washing mode will be described with reference to FIG. 2, and FIGS. 5 to 10.

Figure 5:
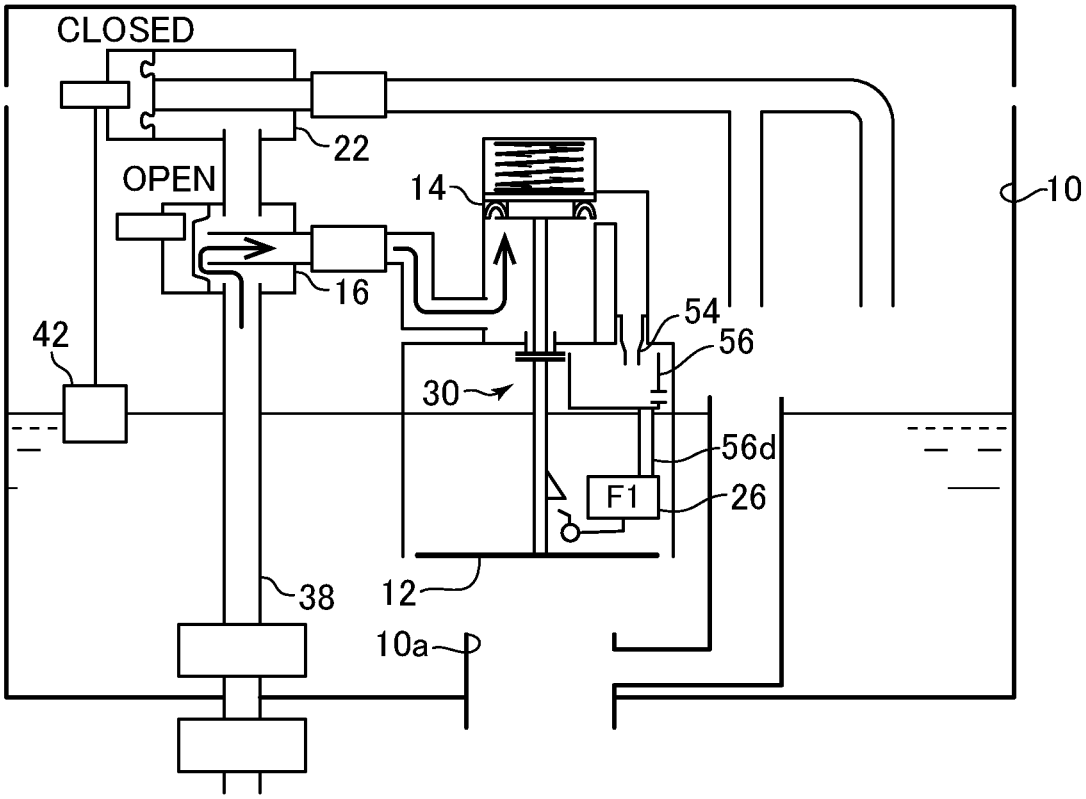
FIG. 5 is a diagram showing operation in a large washing mode of the flush water tank apparatus according to the first embodiment of the present invention.

When receiving an instruction signal to perform large washing, the controller 40 causes the solenoid valve 18 (FIG. 2) provided for the first control valve 16 to operate to cause the pilot valve 16*d* on the solenoid valve side to leave from the pilot valve port. Thereby, the pressure in the pressure chamber 16*c* drops; the main valve body 16*a* leaves from the main valve port 16*b*; and the main valve port 16*b* is opened. When the first control valve 16 is opened, flush water flowing in from the water supply pipe 38 is supplied to the discharge valve hydraulic drive unit 14 via the first control valve 16 as shown in FIG. 5. Thereby, the piston 14*b* of the discharge valve hydraulic drive unit 14 is pushed up; the discharge valve 12 is pulled up via the rod 32; and flush water in the storage tank 10 is discharged from the drain port 10*a* to the flush toilet main body 2.

When the discharge valve 12 is pulled up, the holding claw 12*b* provided on the valve stem 12*a* of the discharge valve 12 causes the engaging member 46*c* of the holding mechanism 46 to be pushed up and rotated, and the holding claw 12*b* gets over the engaging member 46*c* (FIG. 4A-FIG. 4B).

Figure 6:
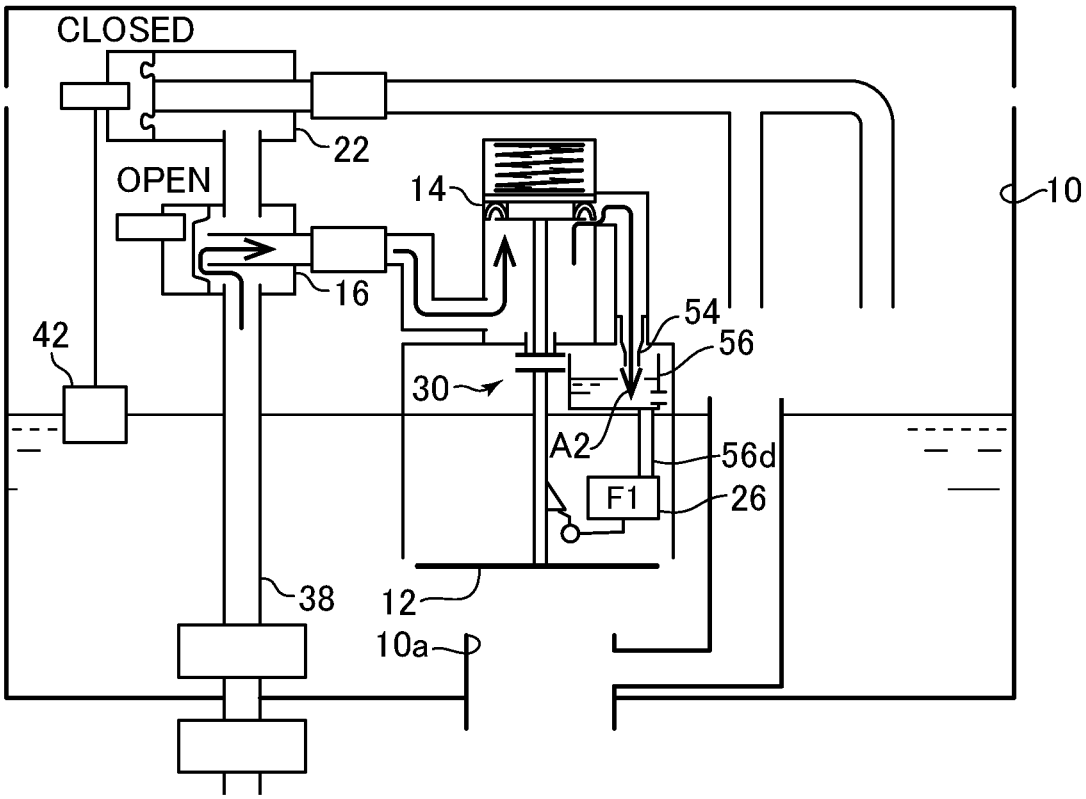
FIG. 6 is a diagram showing the operation in the large washing mode of the flush water tank apparatus according to the first embodiment of the present invention.

Next, when the discharge valve 12 is further pulled up, the clutch mechanism 30 is disconnected as shown in FIG. 6. In other words, when the discharge valve 12 reaches a predetermined height, the upper end of the hook member 30*b* of the clutch mechanism 30 hits the bottom surface of the discharge valve hydraulic drive unit 14, and the clutch mechanism 30 is disconnected (FIG. 3B-FIG. 3C).

When the clutch mechanism 30 is disconnected, the discharge valve 12 starts to descend toward the drain port 10*a* due to its own weight. Here, since the water level in the storage tank 10 is high immediately after the discharge valve 12 is opened, the holding mechanism 46 is in the holding state shown by the solid lines in FIG. 4B.

Therefore, the holding claw 12*b* of the discharge valve 12 that has descended engages with the engaging member 46*c* of the holding mechanism 46, and the discharge valve 12 is held at a predetermined height by the holding mechanism 46. By the discharge valve 12 being held by the holding mechanism 46, the drain port 10*a* is kept in the open state, and discharge of flush water in the storage tank 10 to the flush toilet main body 2 is kept. At this time, the pilot valve 16*d* is still in the open state, and flush water flowing in from the water supply pipe 38 is supplied to the discharge valve hydraulic drive unit 14 via the first control valve 16. Since the piston 14*b* is raised to the second position, and the drive unit water supply passage 34*a* and the drive unit discharge passage 34*b* communicate with each other via the inside of the cylinder 14*a*, flush water is discharged from the discharge unit 54 to the water storage unit 56.

Figure 7:
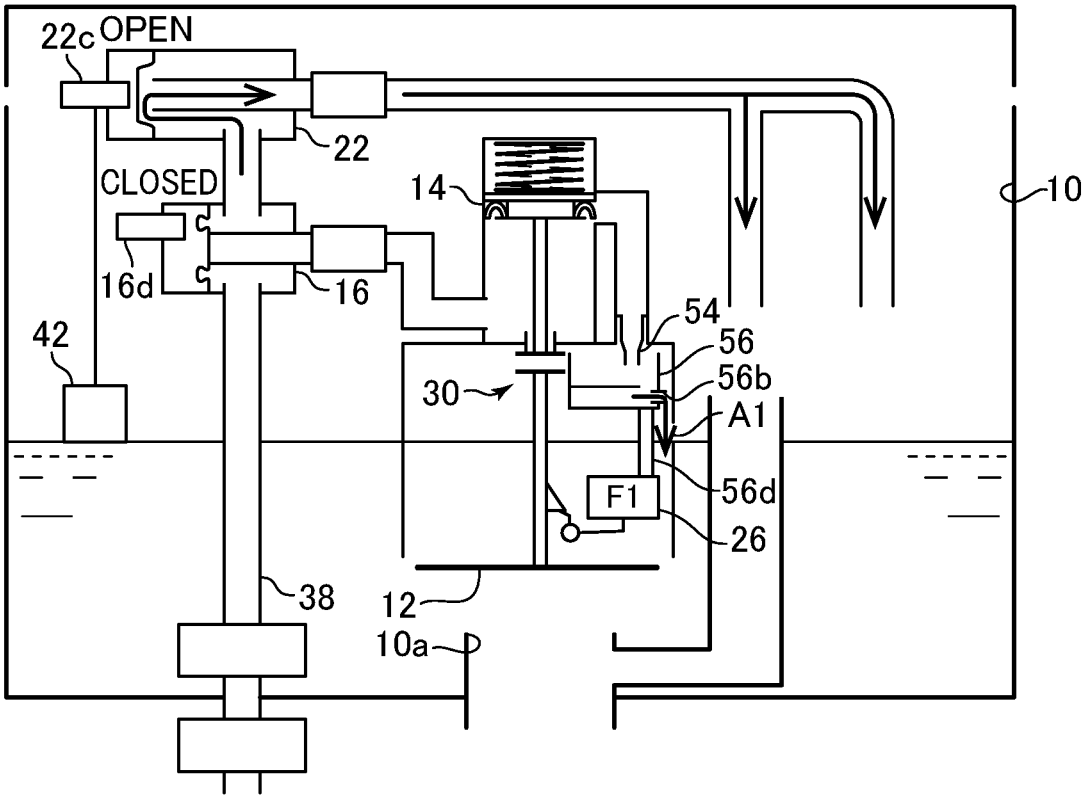
FIG. 7 is a diagram showing the operation in the large washing mode of the flush water tank apparatus according to the first embodiment of the present invention.

Then, when the water level in the storage tank 10 drops as shown in FIG. 7, the float switch 42 that detects the water level in the storage tank 10 is turned off. When the float switch 42 is turned off, the pilot valve 22*c* provided for the second control valve 22 is opened. Thereby, flush water is supplied from the second control valve 22 into the storage tank 10 via the water supply passage 50. When a predetermined time passes after causing the first control valve 16 to open, the controller 40 causes the solenoid valve 18 to operate to close the pilot valve 16*d* on the solenoid valve side. Thereby, the main valve body 16*a* of the first control valve 16 is closed. Note that, in the case of executing the large washing mode, the controller 40 causes the first control valve 16 to be closed in a short time, after the discharge valve 12 is pulled up, and the clutch mechanism 30 is disconnected. Even after the pilot valve 16*d* on the solenoid valve side is closed, the open state of the second control valve 22 is kept, and water supply to the storage tank 10 is continued.

Note that, though the pilot valve 22*c* is opened/closed based on a detection signal of the float switch 42 in the present embodiment, the present invention can be configured so that the pilot valve 22*c* is mechanically opened/closed by a ball tap instead of the float switch 42, as a modification. In this modification, the pilot valve 22*c* is opened/closed in conjunction with a float that moves up and down according to the water level in the storage tank 10.

Since the first control valve 16 is closed, supply of flush water to the discharge valve hydraulic drive unit 14 and the water storage device 52 is stopped. When the large washing mode is executed, a time until the first control valve 16 is closed after being opened is relatively short, and, therefore, flush water stored in the water storage unit 56 does not have weight enough to push down the float 26*a*. Therefore, when the large washing mode is executed, it does not happen that the float 26*a* is pushed down, and the holding mechanism 46 is switched to the non-holding state, even if flush water flows into the water storage unit 56. In other words, the float 26*a* is kept in the state shown by the solid lines in FIG. 4A, and the holding mechanism 46 is kept in the holding state. Further, flush water stored in the water storage unit 56 is gradually discharged from the discharge hole 56*b*.

Figure 8:
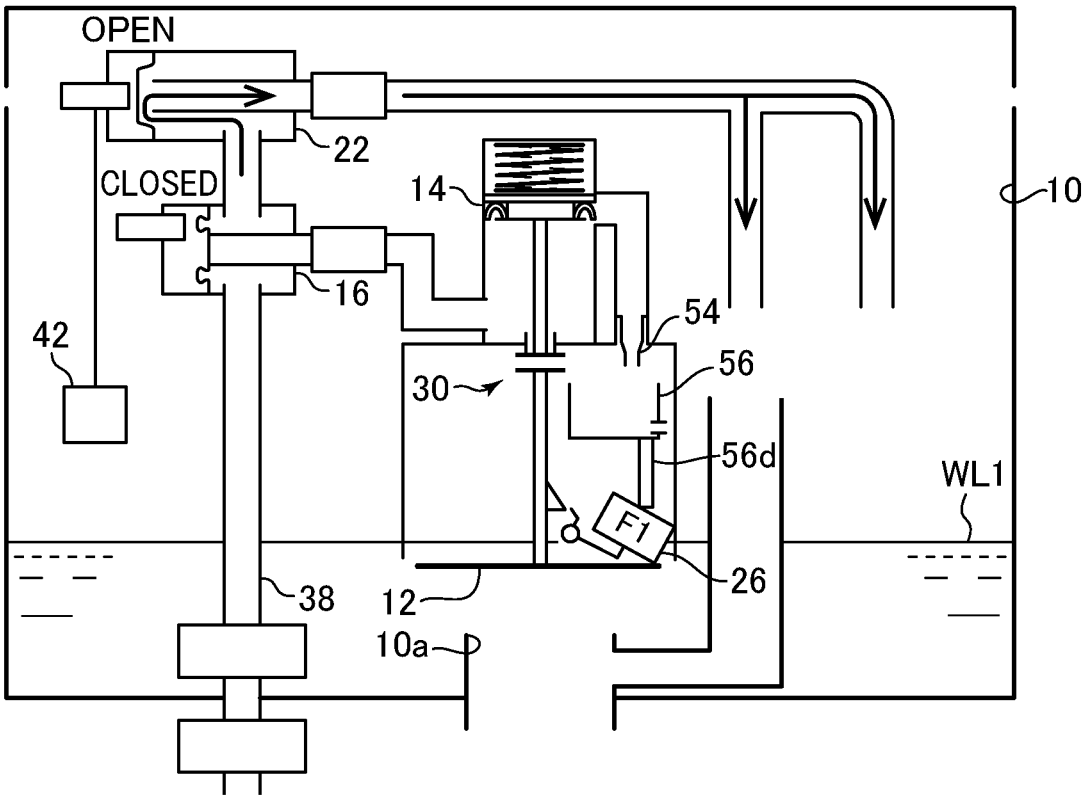
FIG. 8 is a diagram showing the operation in the large washing mode of the flush water tank apparatus according to the first embodiment of the present invention.

As shown in FIG. 8, when the water level in the storage tank 10 drops to a predetermined water level WL1, the position of the float 26*a* connected to the holding mechanism 46 descends. Thereby, the holding mechanism 46 is switched to the non-holding state shown by the imaginary lines in FIG. 4B. Thereby, engagement between the engaging member 46*c* and the holding claw 12*b* of the discharge valve 12 is released. By the holding mechanism 46 being switched to the non-holding state, the discharge valve 12 leaves from the holding mechanism 46 and starts to descend again.

Figure 9:
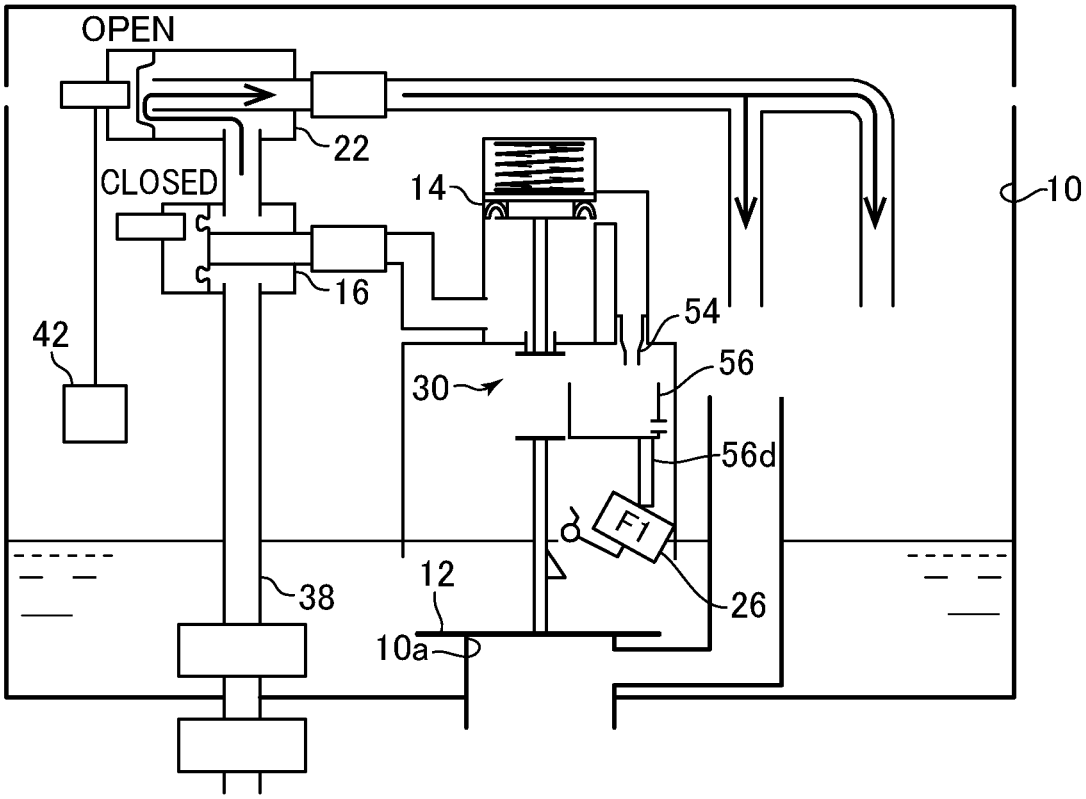
FIG. 9 is a diagram showing the operation in the large washing mode of the flush water tank apparatus according to the first embodiment of the present invention.

Thereby, the discharge valve 12 seats on the drain port 10*a*, and the drain port 10*a* is blocked as shown in FIG. 9. Thus, when the large washing mode is executed, the discharge valve 12 is held until the water level in the storage tank 10 drops from the full water level WL to the predetermined water level WL1, and the first amount of flush water is discharged to the flush toilet main body 2.

Since the float switch 42 is still in the off state, the open state of the second control valve 22 is kept, and water supply to the storage tank 10 is continued. Flush water supplied via the water supply passage 50 reaches the water supply passage branch portion 50*a*, and a part of the flush water branched at the water supply passage branch portion 50*a* flows into the overflow pipe 10*b*, and the remaining flush water is stored in the storage tank 10. The flush water flowing into the overflow pipe 10*b* flows into the flush toilet main body 2 and is used to refill the bowl 2*a*. By flush water flowing into the storage tank 10 in the state of the discharge valve 12 being closed, the water level in the storage tank 10 rises.

Figure 10:
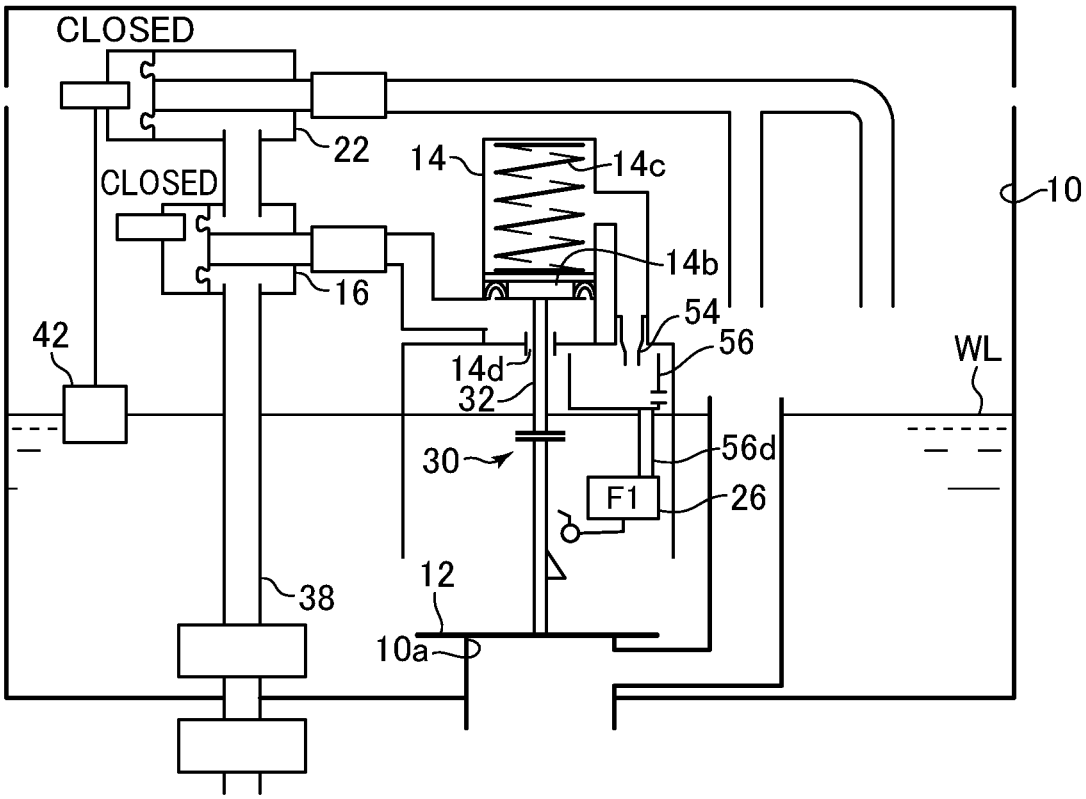
FIG. 10 is a diagram showing the operation in the large washing mode of the flush water tank apparatus according to the first embodiment of the present invention.

When the water level in the storage tank 10 rises to the full water level WL as shown in FIG. 10, the float switch 42 is turned on. When the float switch 42 is turned on, the pilot valve 22*c* on the float switch side is closed. Thereby, the pilot valve 22*c* enters the closed state. Therefore, pressure in the pressure chamber 22*b* rises, the main valve body 22*a* of the second control valve 22 is closed, and water supply is stopped.

After the first control valve 16 is closed, and water supply to the discharge valve hydraulic drive unit 14 is stopped, flush water in the cylinder 14*a* of the discharge valve hydraulic drive unit 14 gradually flows out from the gap 14*d*, the piston 14*b* is pushed down by the energizing force of the spring 14*c*, and, simultaneously, the rod 32 descends as shown in FIG. 10. Thereby, the clutch mechanism 30 is connected (FIG. 3E to FIG. 3H), and the standby state before starting toilet washing is returned to.

Next, operation of the small washing mode will be described with reference to FIG. 2, and FIGS. 11 to 15.

As shown in FIG. 2, the toilet washing standby state is similar to that of the large washing.

When receiving an instruction signal to perform small washing, the controller 40 causes the solenoid valve 18 provided for the first control valve 16 to operate to open the first control valve 16. The controller 40 leaves the second control valve 22 closed.

Figure 11:
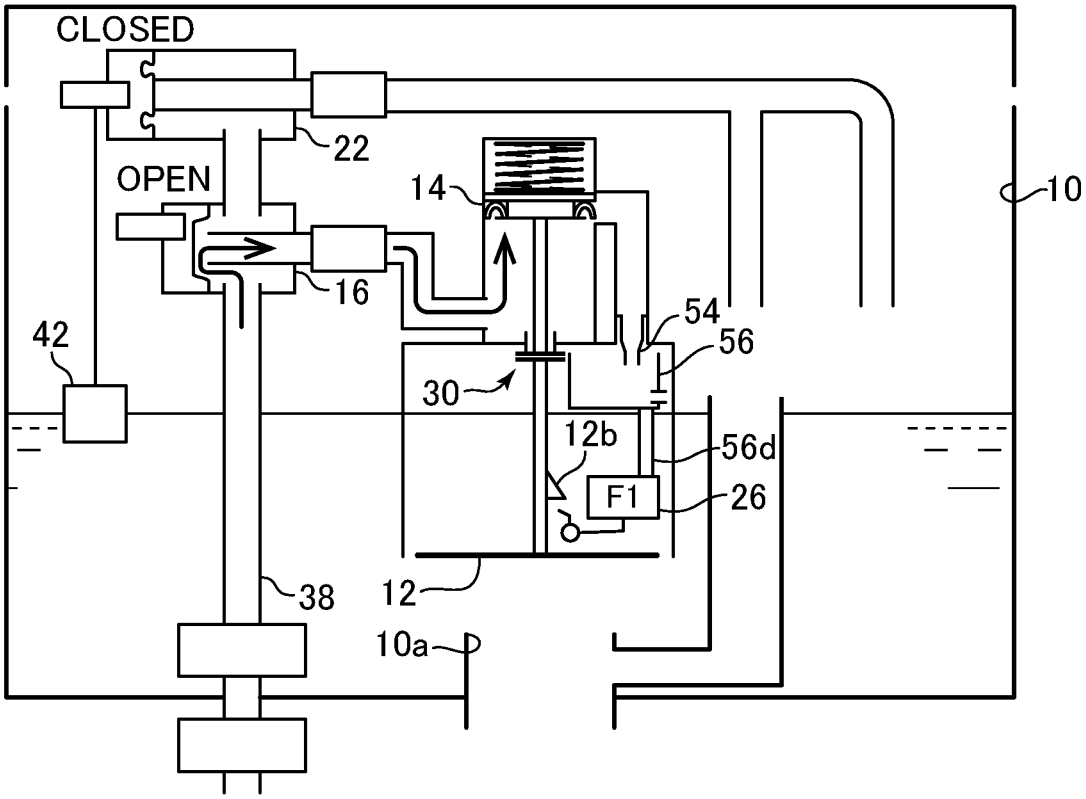
FIG. 11 is a diagram showing operation in a small large washing mode of the flush water tank apparatus according to the first embodiment of the present invention.

When the first control valve 16 is opened, flush water flowing in from the water supply pipe 38 is supplied to the discharge valve hydraulic drive unit 14 via the first control valve 16 as shown in FIG. 11. Thereby, the piston 14*b* of the discharge valve hydraulic drive unit 14 is pushed up; the discharge valve 12 is pulled up via the rod 32; and flush water in the storage tank 10 is discharged from the drain port 10*a* to the flush toilet main body 2. Note that, when the discharge valve 12 is pulled up, the holding claw 12*b* (FIG. 4A) provided on the valve stem 12*a* of the discharge valve 12 pushes up and rotates the engaging member 46*c* of the holding mechanism 46, and the holding claw 12*b* gets over the engaging member 46*c*.

Figure 12:
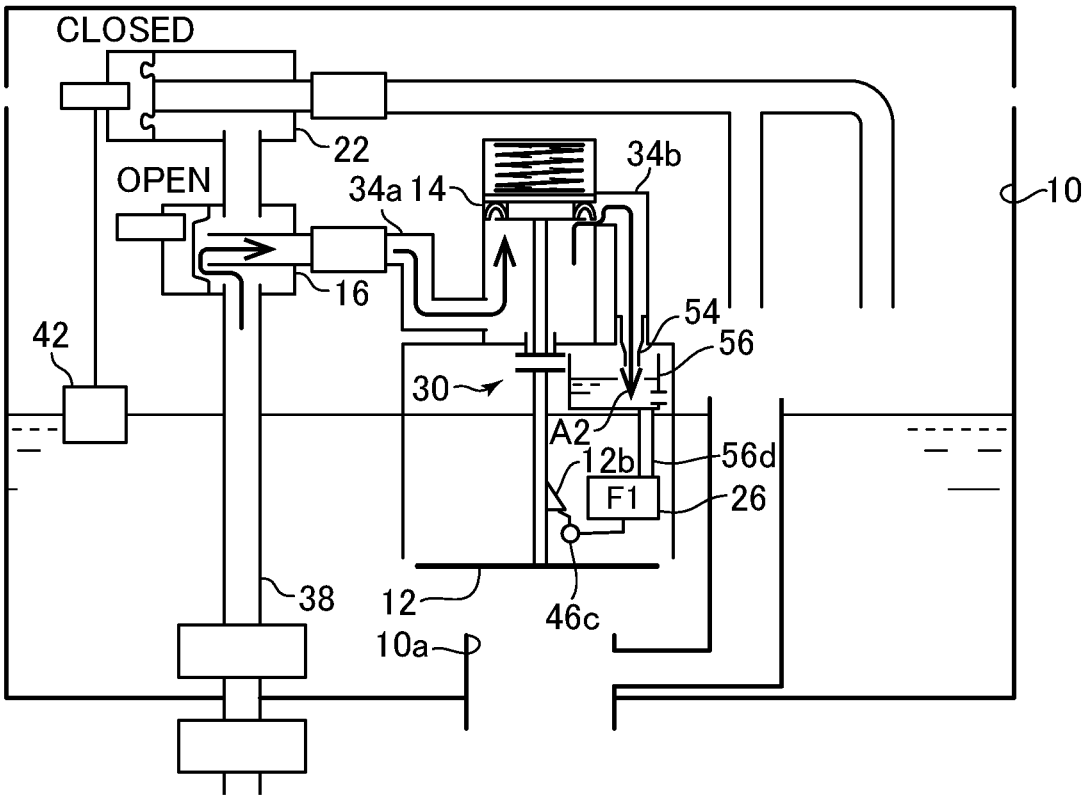
FIG. 12 is a diagram showing the operation in the small large washing mode of the flush water tank apparatus according to the first embodiment of the present invention.

Next, when the discharge valve 12 is further pulled up, the clutch mechanism 30 is disconnected as shown in FIG. 12. In other words, when the discharge valve 12 reaches a predetermined height, the upper end of the hook member 30*b* of the clutch mechanism 30 hits the bottom surface of the discharge valve hydraulic drive unit 14, and the clutch mechanism 30 is disconnected (FIG. 3B-FIG. 3C).

When the clutch mechanism 30 is disconnected, the discharge valve 12 starts to descend toward the drain port 10*a* due to its own weight. Here, since the water level in the storage tank 10 is high immediately after the discharge valve 12 is opened, the holding mechanism 46 is in the holding state shown by the solid lines in FIG. 4B. Therefore, the holding claw 12*b* of the discharge valve 12 that has descended engages with the engaging member 46*c* of the holding mechanism 46, and the discharge valve 12 is held at a predetermined height by the holding mechanism 46. By the discharge valve 12 being held by the holding mechanism 46, the drain port 10*a* is kept in the open state, and discharge of flush water in the storage tank 10 to the flush toilet main body 2 is kept. At this time, the pilot valve 16*d* is still in the open state, and flush water flowing in from the water supply pipe 38 is supplied to the discharge valve hydraulic drive unit 14 via the first control valve 16. Thereby, the piston 14*b* is raised to the second position, and the drive unit water supply passage 34*a* and the drive unit discharge passage 34*b* are caused communicate with each other via the inside of the cylinder 14*a*, so that flush water is supplied to the water storage device 52.

Figure 13:
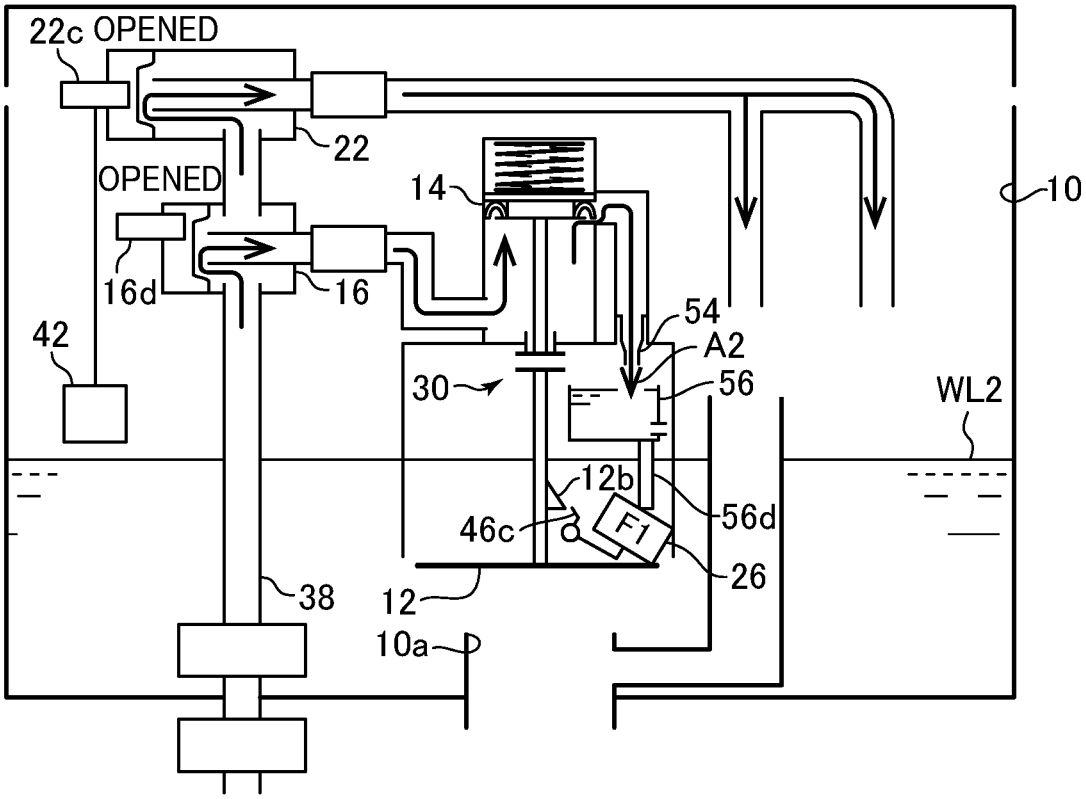
FIG. 13 is a diagram showing the operation in the small large washing mode of the flush water tank apparatus according to the first embodiment of the present invention.

Then, when, by flush water in the storage tank 10 being discharged, the water level in the storage tank 10 drops as shown in FIG. 13, the float switch 42 detecting the water level in the storage tank 10 is turned off. When the float switch 42 is turned off, the pilot valve 22*c* provided for the second control valve 22 is opened. Thereby, flush water is supplied into the storage tank 10 from the second control valve 22 via the water supply passage 50. When the small washing mode is selected, the controller 40 keeps the pilot valve 16*d* of the first control valve 16 open. Thereby, flush water supplied from the water supply pipe 38 is discharged from the discharge unit 54 to the water storage unit 56 via the first control valve 16 and the discharge valve hydraulic drive unit 14.

The flush water discharged from the discharge unit 54 is stored in the water storage unit 56. Further, the flush water in the water storage unit 56 is slightly discharged outside the water storage unit 56 (in the storage tank 10) from the discharge hole 56*b*. The instantaneous flow rate A1 (see FIG. 14) of the flush water discharged from the discharge hole 56*b* is smaller than the instantaneous flow rate A2 (see FIG. 13) of the flush water discharged from the discharge unit 54. Therefore, the weight of the flush water stored in the water storage unit 56 increases. When the weight of the flush water stored in the water storage unit 56 increases enough to overcome buoyancy of the float 26*a*, the rod member 56*d* of the water storage unit 56 pushes down the upper surface 26*b* of the float 26*a* and pushes down the float 26*a*. By the float 26*a* being pushed down, the holding mechanism 46 is switched to the non-holding state shown by the imaginary lines in FIGS. 4A-4B. By the holding mechanism 46 being switched to the non-holding state, engagement between the engaging member 46*c* and the holding claw 12*b* of the discharge valve 12 is released, and the discharge valve 12 leaves from the holding mechanism 46 and starts to descend again.

Figure 14:
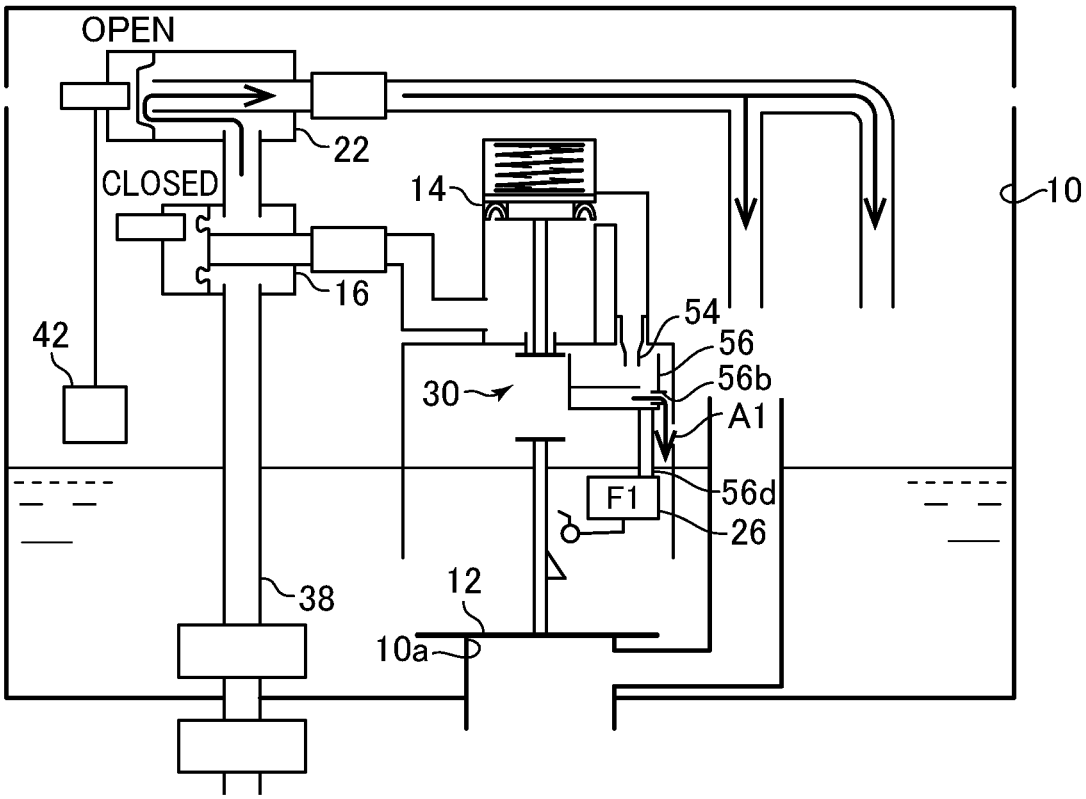
FIG. 14 is a diagram showing the operation in the small large washing mode of the flush water tank apparatus according to the first embodiment of the present invention.

Thereby, the discharge valve 12 seats on the drain port 10*a*, and the drain port 10*a* is blocked as shown in FIG. 14. Thus, when the small washing mode is executed, the amount of flush water stored in the water storage unit 56 increases because the period of the first control valve 16 being open is longer in comparison with the case of the large washing mode being executed, and the float 26*a* is pushed down by the weight of the flush water. Thereby, the holding mechanism 46 of the float device 26 is switched to the non-holding state before the water level in the storage tank 10 drops to the predetermined water level WL1. In other words, in the large washing mode, when the water level in the storage tank 10 drops to the predetermined water level WL1, the holding mechanism 46 is switched to the non-holding state due to the water level drop. In comparison, in the small washing mode, when the water level in the storage tank 10 drops to a water level WL2 higher than the predetermined water level WL1, the float 26*a* is pushed down by the weight of the water storage unit 56, and the holding mechanism 46 is switched to the non-holding state. As a result, in the small washing mode, by the discharge valve 12 being held by the holding mechanism 46 until the water level drops from the full water level WL to the predetermined water level WL2, the second amount of flush water is discharged to the flush toilet main body 2. Therefore, the second amount of flush water discharged from the storage tank 10 in the small washing mode is smaller than the first amount of flush water discharged in the large washing mode.

After the drain port 10*a* is blocked, the float switch 42 is still in the off state, and, therefore, the open state of the second control valve 22 is kept, water supply to the storage tank 10 is continued, and the water level in the storage tank 10 rises again.

When a predetermined time passes after opening the solenoid valve 18, the controller 40 closes the solenoid valve 18. As the predetermined time, for example, a time during which flush water enough for the water storage unit 56 to descend can be supplied to the water storage unit 56 is set. Therefore, after passage of the predetermined time, the first control valve 16 is closed. Discharge of flush water from the discharge unit 54 to the water storage unit 56 is stopped. Flush water stored in the water storage unit 56 is gradually discharged from the discharge hole 56*b*. By the flush water in the water storage unit 56 decreasing and the weight being lighter, the water storage unit 56 is pushed up by the buoyancy that acts on the float 26*a*, and the water storage unit 56 is raised to the position of the standby state again. The flush water in the water storage unit 56 flows out until the water storage unit 56 becomes empty.

Figure 15:
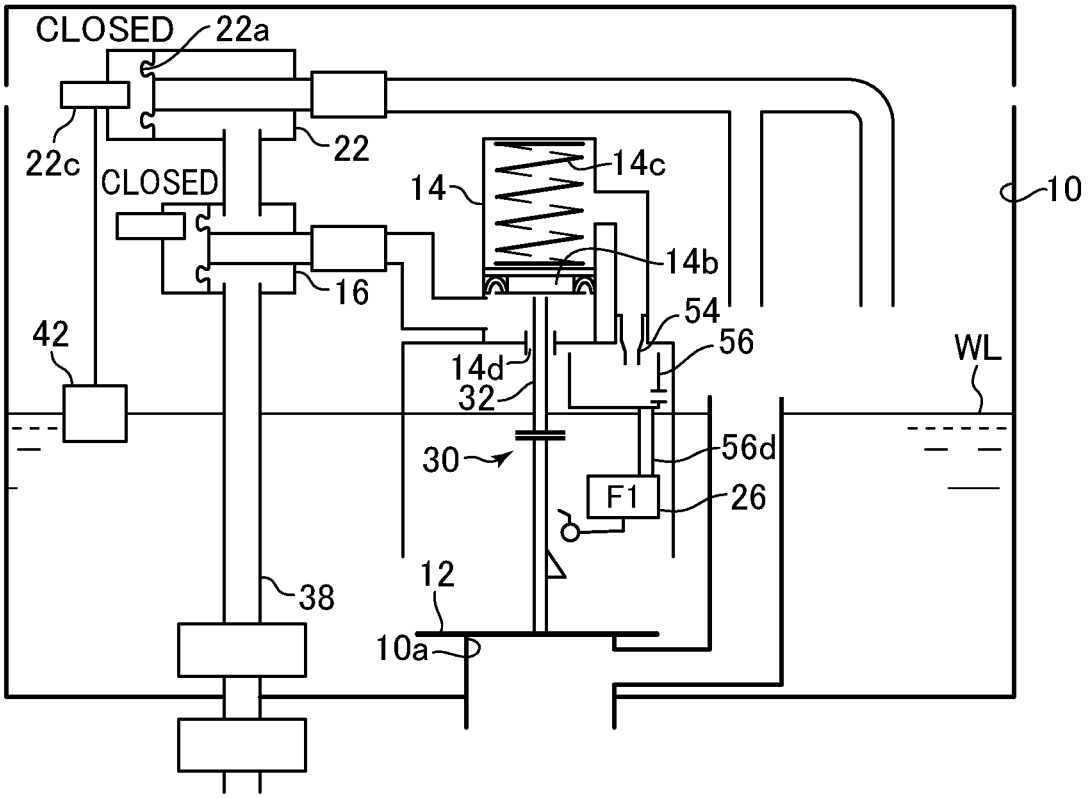
FIG. 15 is a diagram showing the operation in the small large washing mode of the flush water tank apparatus according to the first embodiment of the present invention.

When the water level in the storage tank 10 rises to the full water level WL as shown in FIG. 15, the float switch 42 is turned on. When the float switch 42 is turned on, the pilot valve 22*c* on the float switch side is closed. Since the pilot valve 22*c* enters the closed state thereby, the pressure in the pressure chamber 22*b* rises, the main valve body 22*a* of the second control valve 22 is closed, and water supply is stopped.

After the first control valve 16 is closed, and water supply to the discharge valve hydraulic drive unit 14 is stopped, flush water in the cylinder 14*a* of the discharge valve hydraulic drive unit 14 gradually flows out from the gap 14*d*, the piston 14*b* is pushed down by the energizing force of the spring 14*c*, and, simultaneously, the rod 32 descends as shown in FIG. 15. Thereby, the clutch mechanism 30 is connected (FIG. 3E to FIG. 3H), and the standby state before starting toilet washing is returned to.

According to the flush water tank apparatus 4 according to the first embodiment of the present invention described above, since the discharge valve 12 and the discharge valve hydraulic drive unit 14 are coupled by the clutch mechanism 30 and disconnected at the predetermined timing, it becomes possible to cause the discharge valve 12 to move regardless of the operation speed of the discharge valve hydraulic drive unit 14 and cause the discharge valve 12 to be closed.

When the large washing mode is selected, the holding mechanism 46 of the float device 26 holds the discharge valve 12 until the water level in the storage tank 10 drops to the predetermined water level WL1. When the small washing mode is selected, the water storage device 52, which is the timing control mechanism, switches the holding mechanism 46 to the non-holding state before the water level in the storage tank 10 drops to the predetermined water level WL1. Thereby, it is possible to block the drain port 10*a* at a timing different from the timing in the case of the large washing mode being selected, using the float device 26. Therefore, according to the first embodiment of the present invention, it is possible to set the first or second amount of flush water using the clutch mechanism 30 and the float device 26.

Furthermore, according to the flush water tank apparatus 4 according to the first embodiment of the present invention, when the second amount of flush water is selected by the remote controller 6, the water storage device 52 can cause the holding mechanism 46 to be in the non-holding state before the holding mechanism 46 is caused to be in the non-holding state by movement of the float 26*a* accompanying drop of the water level in the storage tank 10. Thereby, it is possible to cause the discharge valve 12 to descend without waiting for drop of the water level in the storage tank 10, and set the second amount of flush water smaller than the first amount of flush water. Further, if the water storage device 52 does not operate due to a fault, the first amount of flush water is discharged. Therefore, it is possible to avoid shortage of flush water.

Furthermore, according to the flush water tank apparatus 4 according to the first embodiment of the present invention, when the second amount of flush water is selected by the remote controller 6, the water storage device 52 switches the holding mechanism 46 to the non-holding state before the water level in the storage tank 10 drops to the predetermined water level WL1. Thereby, the discharge valve 12 that starts to descend by the clutch mechanism 30 being disconnected descends below the holding mechanism 46 before the water level in the storage tank 10 drops to the predetermined water level WL1, and blocks the drain port 10*a*. As a result, it is possible to certainly cause the float device 26 to operate and set the second amount of flush water smaller than the first amount of flush water.

Furthermore, according to the flush water tank apparatus 4 according to the first embodiment of the present invention, since it is possible to switch the holding mechanism 46 of the float device 26 to the non-holding state using tap water, it is possible to control the timing of causing the discharge valve 12 to descend, by a compact and simple configuration without providing a special actuator or the like for switching the holding mechanism 46, in the storage tank 10.

Furthermore, according to the flush water tank apparatus 4 according to the first embodiment of the present invention, since it is possible to use the same first control valve 16 as a control valve for supplying flush water to the water storage device 52 and a control valve for supplying flush water to the discharge valve hydraulic drive unit 14, it is possible to control the timing of causing the discharge valve 12 to descend, with a more compact and simpler configuration.

Furthermore, according to the flush water tank apparatus 4 according to the first embodiment of the present invention, since the water storage device 52 is provided on the downstream side of the discharge valve hydraulic drive unit 14, flush water supplied from the first control valve 16 can be used to supply flush water to the water storage device 52. Thereby, in comparison with the case of supplying flush water to the water storage device 52 and the discharge valve hydraulic drive unit 14 separately, it is possible to cause the water storage device 52 and the discharge valve hydraulic drive unit 14 to operate with a small amount of flush water and reduce wasted flush water.

According to the flush water tank apparatus 4 according to the first embodiment of the present invention, it is possible to cause the discharge valve 12 to descend at a timing according to a selected amount of flush water, by the simple control of changing the period of flush water being supplied to the water storage device 52, by the first control valve 16.

Furthermore, according to the flush water tank apparatus 4 according to the first embodiment of the present invention, it is possible to control the timing of causing the discharge valve 12 to descend by the simple control of, when the second amount of flush water is selected by the remote controller 6, causing the period of flush water being supplied to the water storage device 52 to be longer in comparison with the case of the first amount of flush water being selected, by the first control valve 16.

Furthermore, according to the flush water tank apparatus 4 according to the first embodiment of the present invention, the first control valve 16 supplies flush water to the water storage device 52 after the clutch mechanism 30 is disconnected. Thereby, the water storage device 52 can control the timing of causing the discharge valve 12 to descend, without hindering the operation of the discharge valve 12 being pulled up by the clutch mechanism 30.

Further, according to the flush water tank apparatus 4 according to the first embodiment of the present invention described above, since the discharge valve 12 and the discharge valve hydraulic drive unit 14 are coupled by the clutch mechanism 30 and disconnected at the predetermined timing, it becomes possible to cause the discharge valve 12 to move regardless of the operation speed of the discharge valve hydraulic drive unit 14 and cause the discharge valve 12 to be closed. Thereby, it becomes possible to, even if the operation speed of the discharge valve hydraulic drive unit 14 varies at the time of causing the discharge valve 12 to descend, control the timing of causing the discharge valve 12 to be closed without being influenced by the variation. When the second amount of flush water is selected by the remote controller 6, the timing of causing the discharge valve 12 to descend can be controlled by the float device 26 so that the timing of the drain port 10*a* being blocked is earlier than the case of the first amount of flush water being selected. Therefore, according to the first embodiment of the present invention, it is possible to set the first or second amount of flush water using the clutch mechanism 30.

Furthermore, according to the flush water tank apparatus 4 according to the first embodiment of the present invention, when the second amount of flush water is selected by the remote controller 6, the float device 26 can control the timing of causing the discharge valve 12 to descend, by flush water discharged from the discharge unit 54 and can set the first and second amounts of flush water using the clutch mechanism 30. Thereby, for example, in comparison with a case of the float device 26 being operated by a motor, an electric drive unit and the like can be omitted, and the float device 26 can control the timing of causing the discharge valve 12 to descend by a compact and simple configuration and can set the first and second amounts of flush water using the clutch mechanism 30.

Furthermore, according to the flush water tank apparatus 4 according to the first embodiment of the present invention, when the second amount of flush water is selected by the remote controller 6, the float device 26 can control the timing of causing the discharge valve 12 to descend, by weight of flush water stored in the water storage unit 56. Thereby, it is possible to control the timing of causing the discharge valve 12 to descend by a simpler configuration and set the first and second amounts of flush water, using the clutch mechanism 30.

Furthermore, according to the flush water tank apparatus 4 according to the first embodiment of the present invention, the float device 26 can control the timing of causing the discharge valve 12 to descend, by the amount of flush water smaller than the amount of flush water to drive the piston 14*b* of the discharge valve hydraulic drive unit 14 being stored in the water storage unit 56, and the float device 26 can control the timing of causing the discharge valve 12 to descend relatively early with a relatively small amount of flush water.

Furthermore, according to the flush water tank apparatus 4 according to the first embodiment of the present invention, since the discharge unit 54 forms a downward discharge port, force of flush water discharged downward can be added to the weight of flush water stored in the water storage unit 56, so that the size of the water storage unit 56 can be reduced, and the float device 26 can control the timing of causing the discharge valve 12 to descend relatively early with a smaller amount of flush water.

Furthermore, according to the flush water tank apparatus 4 according to the first embodiment of the present invention, since the discharge unit 54 is arranged inside the water storage unit 56 and at a height lower than the upper end of the water storage unit 56, it is possible to prevent discharged flush water from being dispersed outside the water storage unit 56, and the float device 26 can control the timing of causing the discharge valve 12 to descend by supply of a smaller amount of flush water. Further, by flush water being prevented from being dispersed outside the water storage unit 56, it is possible to prevent malfunction of the clutch mechanism 30 and other equipment in the storage tank 10 from occurring due to dispersed flush water and prevent dispersed flush water from falling into the storage tank 10 and causing a strange sound.

Furthermore, according to the flush water tank apparatus 4 according to the first embodiment of the present invention, the water storage unit 56 is prevented from receiving buoyancy of flush water stored in the storage tank 10, and the float device 26 can control the timing of causing the discharge valve 12 to descend by supply of a smaller amount of flush water.

Furthermore, according to the flush water tank apparatus 4 according to the first embodiment of the present invention, since the discharge hole **56*b* for discharging stored flush water is formed in the water storage unit 56, the water storage unit 56** is capable of both of storing flush water and causing the flush water to be discharged by a relatively simple configuration.

Furthermore, according to the flush water tank apparatus 4 according to the first embodiment of the present invention, it is possible to prevent a flow of flush water discharged from the discharge hole **56*b* from acting on equipment provided on the discharge valve 12 side, for example, equipment such as the holding mechanism and the float of the float device 26** and causing the equipment to malfunction.

Furthermore, according to the flush water tank apparatus 4 according to the first embodiment of the present invention, since the instantaneous flow rate of the flush water discharged from the discharge hole **56*b* is smaller than the instantaneous flow rate of the flush water discharged from the discharge unit 54, flush water can be efficiently stored in the water storage unit 56, and the float device 26 can control the timing of causing the discharge valve 12** to descend by supply of a smaller amount of flush water.

Furthermore, according to the flush water tank apparatus 4 according to the first embodiment of the present invention, the float device 26 can stably control the timing of causing the discharge valve 12 to descend, by a relatively simple mechanical structure. According to such a structure, in comparison with a case of adopting a mechanism in which, when a seesaw-shaped transmission portion is used for the water storage unit 56 to ascend due to the weight of the amount of flush water stored in the water storage unit 56 becoming a predetermined weight or below, downward force is transmitted to the opposite side of the transmission portion to cause the float of the float device 26 to descend, the rod member **56*d* of the float device 26 directly transmits descending force of the water storage unit 56 so as to cause the float 26*a* to descend, and it is possible to control the timing of causing the discharge valve 12** to descend, with a higher accuracy.

The first embodiment of the present invention has been described above. Various changes can be added to the first embodiment described above. For example, though the water storage unit 56 is provided with the rod member **56*d* in the first embodiment described above, a seesaw-type force transmission device (a seesaw-shaped transmission unit) in such a shape that the letter Z is rotated by 90 degrees may be arranged instead of the rod member 56*d* as a modification. One end of the force transmission device is connected to the bottom surface of the water storage unit 56, and the other end of the force transmission device is arranged near the upper surface 26*b* of the float 26*a*. A rotation center shaft is provided at the center of the force transmission device. When the water storage unit 56 descends, and the one end of the force transmission device descends, the other end of the force transmission device ascends like a seesaw. Furthermore, an energizing member is provided on the bottom surface of the water storage unit 56, and the water storage unit 56 is energized upward. In this configuration, when there is little flush water in the water storage unit 56, the water storage unit 56 and the one end of the force transmission device ascend, while the other end of the force transmission device descends and pushes down the float 26*a*. On the contrary, when the flush water stored in the water storage unit 56 increases, the water storage unit 56 descends, and the other end of the force transmission device ascends. Therefore, the float device 26 is switched between the holding state and the non-holding state according to the water level in the storage tank 10**.

In this modification, when the large washing mode is selected, the controller 40 causes flush water to be discharged from the discharge unit 54 to the water storage unit 56, causes the water storage unit 56 to descend and causes the float **26*a* not to descend, via the force transmission device at least until the water level in the storage tank 10 reaches the predetermined water level WL1, and the float 26*a* descends according to the water level. Thereby, the discharge valve 12 is caused to descend at a timing corresponding to the predetermined water level WL1, which is an original descent timing according to the water level of the float 26*a*, and the large washing mode is achieved. In other words, the period during which flush water flows into the water storage unit 56 is lengthened to cause the water storage unit 56 to descend so that the holding state and the non-holding state of the float device 26 can be switched according to the water level in the storage tank 10**.

When the small washing mode is selected, the controller 40 causes the water storage unit 56 to ascend and causes the float **26*a* to descend via the force transmission device, by closing the solenoid valve 18 when a predetermined time during which the second amount of flush water can be discharged has passed after opening the solenoid valve 18, and stopping discharge of the discharge unit 54 to shorten the period during which flush water flows into the water storage unit 56. Thereby, the discharge valve 12 is caused to descend by causing the float 26*a*** to forcedly descend at such a predetermined timing that the second amount of flush water can be discharged, and the small washing mode is achieved.

Further, for example, though the water storage device 52 that causes flush water discharged from the discharge unit 54 to function as water weight that pushes down the float device 26 is provided as the timing control mechanism of the flush water tank apparatus 4 in the first embodiment described above, a configuration may be made in which the float device 26 is pushed down by kinetic energy of the flush water discharged from the discharge unit 54 as a second modification of the timing control mechanism. In other words, the present invention can be configured with the discharge unit 54 as the timing control mechanism. In this modification, flush water is supplied to the discharge unit 54 via a control valve provided separately from the first control valve 16.

In this modification, when the large washing mode is selected, the controller 40 causes the discharge unit 54 not to discharge flush water and causes the float device 26 not to descend at least until the water level in the storage tank 10 reaches the predetermined water level WL1, and the float device 26 descends according to the water level. Thereby, the discharge valve 12 is caused to descend at the timing corresponding to the predetermined water level WL1, which is the original descent timing of the float device 26, and the large washing mode can be executed.

Further, when the small washing mode is selected, the controller 40 switches the holding mechanism 46 of the float device 26 to the non-holding state, by causing the discharge unit 54 to discharge flush water at a predetermined timing and causing the float 26*a* to forcedly descend. Thereby, the discharge valve 12 is caused to descend at a timing corresponding to the predetermined water level WL2, and the small washing mode can be executed.

Or alternatively, as a modification of the second modification, a configuration can be made in which the seesaw-type force transmission device as that in the modification described above is arranged near the upper surface 26*b* of the float 26*a*. In such a modification, when flush water is jetted toward the force transmission device from the discharge unit 54, the force transmission device does not interfere with the float 26*a* and does not transmit force. On the other hand, when the jet of flush water to the force transmission device is stopped, the force transmission device pushes down the float 26*a*, and the float device 26 is switched to the non-holding state.

In this modification, when the large washing mode is selected, the controller 40 causes the float device 26 not to descend, via the force transmission device by continuing discharging flush water from the discharge unit 54 without closing the first control valve 16, at least until the water level in the storage tank 10 reaches the predetermined water level WL1, and the float device 26 descends according to the water level. Thereby, the discharge valve 12 is caused to descend at the timing corresponding to the predetermined water level WL1, which is the original descent timing of the float device 26, and the large washing mode can be executed.

Further, when the small washing mode is selected, the controller 40 switches the holding mechanism 46 of the float device 26 to the non-holding state by causing the float device 26 to forcedly descend via the force transmission device by closing the first control valve 16 when the predetermined time during which the second amount of flush water can be discharged has passed and stopping discharge from the discharge unit 54. Thereby, the discharge valve 12 is caused to descend at the timing corresponding to the predetermined water level WL2, and the small washing mode can be executed.

Further, as a third modification of the timing control mechanism of the flush water tank apparatus 4, a hydraulic drive device can be adopted which is provided with a pressure chamber into which flush water flows and a rod that moves toward the float device 26 by receiving water supply pressure of the flush water that flows into the pressure chamber. In other words, the present invention can be configured, with the hydraulic drive device that causes the rod to move by water supply pressure applied on the pressure chamber as the timing control mechanism. In this modification, the configuration is made so that the float 26*a* of the float device 26 is pushed down by the rod of the hydraulic drive device.

In this modification, when the large washing mode is selected, the controller 40 does not supply flush water to the hydraulic drive device and causes the float device 26 not to descend at least until the water level in the storage tank 10 reaches the predetermined water level WL1, and the float device 26 descends according to the water level. Thereby, the discharge valve 12 is caused to descend at the timing corresponding to the predetermined water level WL1, which is the original descent timing of the float device 26, and the large washing mode can be executed.

When the small washing mode is selected, the controller 40 supplies flush water to the hydraulic drive device at a predetermined timing and causes the flush water to flow into the pressure chamber. By the water supply pressure in the pressure chamber increasing, the rod is moved toward the float 26*a*, and the float device 26 is forcedly switched to the non-holding state. Thereby, the discharge valve 12 is caused to descend at the timing corresponding to the predetermined water level WL2, and the small washing mode can be executed.

Or alternatively, as a modification of the third modification, the hydraulic drive device can be configured so that the rod ascends when receiving the water supply pressure of flush water flowing into the pressure chamber, and the rod descends when water supply is stopped.

In this modification, when the large washing mode is selected, the controller 40 continues supplying flush water to the pressure chamber of the hydraulic drive device at least until the water level in the storage tank 10 reaches the predetermined water level WL1, and the float device 26 descends according to the water level. By the water supply pressure in the pressure chamber being kept high, the rod causes the float device 26 not to descend. Thereby, the discharge valve 12 is caused to descend at the timing corresponding to the predetermined water level WL1, which is the original descent timing of the float device 26, and the large washing mode can be executed.

When the small washing mode is selected, the controller 40 causes supply of flush water to the pressure chamber of the hydraulic drive device to stop when the predetermined time during which the second amount of flush water can be discharged has passed. By the pressure in the pressure chamber decreasing, the rod of the hydraulic drive device is moved toward the float device 26. Thereby, the float 26*a* is caused to forcedly descend, and the holding mechanism 46 of the float device 26 is switched to the non-holding state. Thereby, the discharge valve 12 is caused to descend at the timing corresponding to the predetermined water level WL2, and the small washing mode can be executed.

Further, as a fourth modification of the timing control mechanism of the flush water tank apparatus 4, it is possible to provide a small tank for storing flush water and provide a second float in the small tank. A configuration is made in which a rod is connected to the bottom surface of the second float in the small tank, and the float 26*a* is pushed down by this rod. In other words, the present invention can be configured, with a configuration in which, when the water level in the small tank drops, the rod descends together with the second float and pushes down the float 26*a*, as the timing control mechanism.

In this modification, when the large washing mode is selected, the controller 40 prevents the water level in the small tank from dropping to cause the second float in the small tank not to descend, by continuing supplying flush water to the small tank at least until the water level in the storage tank 10 reaches the predetermined water level WL1, and the float device 26 descends according to the water level. Thereby, it does not happen that the float 26*a* is caused to descend by the rod connected to the bottom surface of the second float; the discharge valve 12 is caused to descend at the timing corresponding to the predetermined water level WL1, which is the original descent timing of the float device 26; and the large washing mode can be executed.

When the small washing mode is selected, the controller 40 causes supply of flush water to the small tank to stop when the predetermined time during which the second amount of flush water can be discharged has passed. By the water level in the small tank dropping, the rod descends together with the second float, the float 26*a* is caused to forcedly descend, and the holding mechanism 46 of the float device 26 is switched to the non-holding state. Thereby, the discharge valve 12 is caused to descend at the timing corresponding to the predetermined water level WL2, and the small washing mode can be executed.

Or alternatively, as a modification of the fourth modification, a configuration can be made in which a seesaw-type force transmission device as that in the modification described above is connected to the bottom surface of the second float in the small tank. In this modification, when the water level in the small tank rises, the second float also rises, and the force transmission device connected to the second float pushes down the float 26*a*.

In this modification, when the large washing mode is selected, the controller 40 causes flush water not to flow into the small tank and causes the float 26*a* not to descend at least until the water level in the storage tank 10 reaches the predetermined water level WL1, and the float device 26 descends according to the water level. Thereby, the discharge valve 12 is caused to descend at the timing corresponding to the predetermined water level WL1, which is the original descent timing of the float device 26, and the large washing mode can be executed.

When the small washing mode is selected, the controller 40 causes flush water to flow into the small tank at a predetermined timing to cause the water level in the small tank to rise. The second float rises together with the rise of the water level in the small tank; the float 26*a* is caused to forcedly descend via the force transmission device; and the holding mechanism 46 of the float device 26 is switched to the non-holding state. Thereby, the discharge valve 12 is caused to descend at the timing corresponding to the predetermined water level WL2, and the small washing mode can be executed.

Further, for example, though the drive unit discharge passage 34*b* leading to the discharge unit 54 is connected to the discharge valve hydraulic drive unit 14 in the first embodiment described above, the drive unit discharge passage 34*b* may be omitted, and the discharge unit 54 may be connected to the water supply passage 50 as a further modification. In this case, by arranging the discharge unit 54 at the distal end of the water supply passage 50 extending from the second control valve 22, toward the water storage unit 56, and causing the second control valve 22 to open at a predetermined timing, flush water is supplied to the water storage unit 56 from the discharge unit 54 of the water supply passage 50. In this case, a water supply device is separately provided for the flush water tank apparatus 4 to supply water to the storage tank 10. Thereby, the controller 40 can supply flush water from the discharge unit 54 to the water storage unit 56 at an arbitrary timing by controlling the second control valve 22 and execute control of the large washing mode and the small washing mode.

Further, for example, though the flush water tank apparatus 4 is provided with the float device 26 that is used for both of the large washing mode and the small washing mode in the first embodiment described above, the flush water tank apparatus 4 may be provided with a float device for the large washing mode and a float device for the small washing mode separately as a further modification. The float device for the large washing mode forms the timing control mechanism for holding the pulled-up discharge valve 12 at a first position. The float device for the small washing mode forms a timing control mechanism for holding the pulled-up discharge valve 12 at a second position lower than the first position. Each of basic configurations of both float devices is similar to the float device 26. The rod member 56*d* of the water storage unit 56 is formed so as to act on the float device for the large washing mode. A description will be made on a case of adopting a structure which is provided with the above structure of the modification and in which the drive unit discharge passage 34*b* as in the modification described above is omitted, and the discharge unit 54 is connected to the water supply passage 50.

When the large washing mode is selected, the controller 40 causes flush water not to be discharged from the discharge unit 54 of the water supply passage 50 to the water storage unit 56 and causes the float device for the large washing mode not to descend by the rod member 56*d* of the water storage unit 56 at least until the water level in the storage tank 10 reaches the predetermined water level WL1, and the float device for the large washing mode descends according to the water level. Thereby, the discharge valve 12 is caused to descend at the timing corresponding to the predetermined water level WL1, which is an original descent timing of the float device for the large washing mode according to the water level, and the large washing mode can be executed.

Further, when the small washing mode is selected, the controller 40 supplies flush water from the discharge unit 54 of the water supply passage 50 to the water storage unit 56 by opening the second control valve 22 at a predetermined timing, causes the rod member 56*d* of the water storage unit 56 to descend, forcingly pushes down the float device for the large washing mode, and causes the holding mechanism 46 extending from the float device for the large washing mode to the non-holding state. Thereby, the holding claw 12*b* of the descending discharge valve 12 is in the holding state by the holding mechanism 46 of the float device for the small washing mode. After that, the float device for the small washing mode is caused to descend at the timing corresponding to the predetermined water level WL2; the holding mechanism 46 of the float device for the small washing mode enters the non-holding state and causes the discharge valve 12 to descend, and the small washing mode for discharging the second amount of flush water can be executed.

For example, though the rod member 56*d* of the water storage unit 56 is provided so as to push down the upper surface of the float 26*a* in the first embodiment described above, a rod member arranged horizontally relative to the water storage unit 56 may move horizontally due to descent of the water storage unit 56 and acts on the clutch mechanism 30 to disconnect the clutch mechanism 30, as a further modification. To make a description on the present modification, the water storage unit 56 is provided with a rod member that is horizontally movable, and a sloped portion that obliquely rises from the bottom surface of the water storage unit 56. The distal end of the rod member is formed in a T shape. By causing the T-shaped portion to act on the clutch mechanism 30, the clutch mechanism 30 can be disconnected early. By coming into contact with the base portion of the rod member, the sloped portion converts downward movement of the water storage unit 56 to horizontal movement of the rod member. In this way, by causing the rod member to move in the horizontal direction to a position where the T-shaped portion acts on the clutch mechanism 30, at a relatively early timing, accompanying the descent of the water storage unit 56, the water storage unit 56 can disconnect the clutch mechanism 30. The above structure may be changed to another structure capable of acting on the clutch mechanism 30 due to descent of the water storage unit 56 to disconnect the clutch mechanism 30.

By forming the structure as described above, the height to which the discharge valve 12 is pulled up (the height at which the clutch mechanism 30 is disconnected) is adjusted; and, in the large washing mode, the clutch mechanism 30 is disconnected not by the water storage unit 56 but by the bottom surface of the discharge valve hydraulic drive unit 14, which is an original disconnection position, so that the discharge valve 12 is held by the holding mechanism 46 connected to the float device for the large washing mode. Thereby, the large washing mode can be achieved. Further, in the small washing mode, the clutch mechanism 30 is disconnected early by operation of the water storage unit 56 so that the discharge valve 12 is held by the holding mechanism 46 connected to the float device for the small washing mode, and, thereby, the small washing mode is achieved.

For example, though the flush water tank apparatus 4 is provided with the float device 26 in the first embodiment described above, the float device 26 may be omitted, and a rod member arranged horizontally relative to the water storage unit 56 may move horizontally due to descent of the water storage unit 56 and acts on the clutch mechanism 30 so that the clutch mechanism 30 is disconnected early, like the modification described above, as a further modification. In other words, in the present modification, by omitting the float device 26, and disconnecting the clutch mechanism 30 at an arbitrary timing according to the amount of flush water supplied to the water storage unit 56, the large washing mode and the small washing mode can be executed. Note that modifications have been illustrated as described above, the structure of each modification and the structure of the one embodiment may be arbitrarily recombined, or extracted and changed.

Next, a description will be made on a flush water tank apparatus according to a second embodiment of the present invention with reference to FIGS. 16 to 27. Note that, as for portions of a flush water tank apparatus 104 according to the second embodiment of the present invention shown in FIGS. 16 to 27 that are the same as portions of the flush water tank apparatus 4 according to the first embodiment of the present invention described above and shown in FIGS. 1 to 15, the same reference numerals will be given, and description thereof will be omitted.

First, in the flush water tank apparatus 104 according to the second embodiment of the present invention shown in FIGS. 16 to 26, the remote controller 6 functions as the flush water amount selection device capable of selecting between a first amount of flush water for washing the flush toilet main body 2 and a second amount of flush water larger than the first amount of flush water. The configuration of the timing control mechanism for controlling the timing of the discharge valve 12 descending and the drain port 10*a* being blocked is different from the structure of the flush water tank apparatus 4 according to the first embodiment described above.

Figure 16:
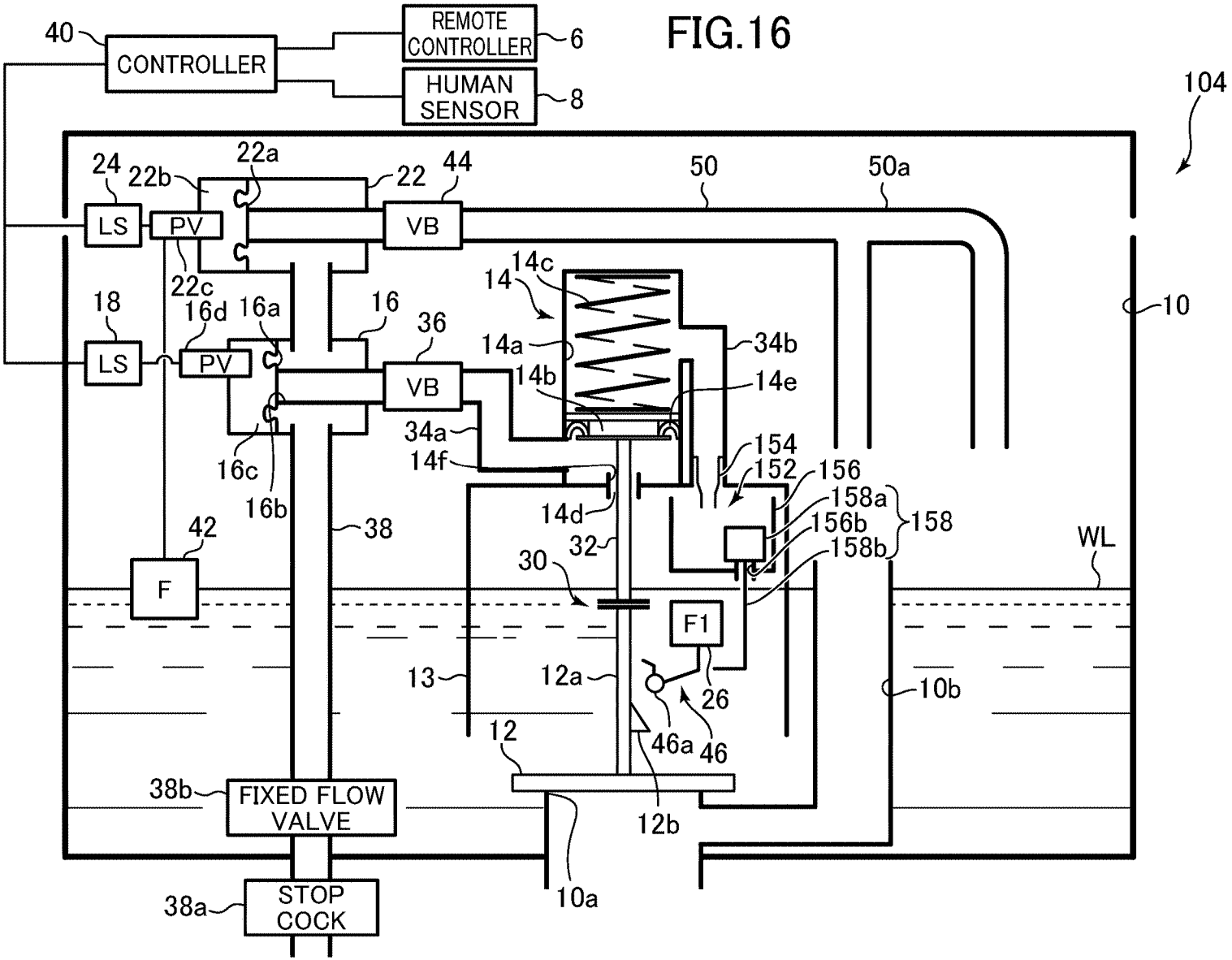
FIG. 16 is a sectional view showing a schematic configuration of a flush water tank apparatus according to a second embodiment of the present invention.

As shown in FIG. 16, a small tank device 152, which is the timing control mechanism, is provided with a discharge unit 154 that discharges supplied flush water, a small tank 156 that stores the flush water discharged from the discharge unit 154, and a second float device 158 that moves according to the water level in the small tank 156. In other words, while the structure of the discharge unit 154 is in common with the structure of the discharge unit 54 of the first embodiment described above, the structure of the small tank 156 and the structure of the second float device 158 being arranged in the small tank 156 are different from the flush water tank apparatus 4 of the first embodiment described above.

The small tank 156 is fixed above the stopped water level (the full water level WL) of the storage tank 10. The small tank 156 is formed in a hollow box shape with the upper surface open, and a discharge hole 156*b* for discharging stored flush water is formed. The discharge hole 156*b* forms a small hole with a relatively small diameter. Therefore, the instantaneous flow rate of flush water discharged outside the small tank 156 (in the storage tank 10) from the discharge hole 156*b* is smaller than the instantaneous flow rate of flush water discharged from the discharge unit 154.

Further, the small tank 156 is arranged on the lower side of the discharge unit 154 and is configured so that flush water discharged from the discharge unit 154 flows in. The small tank 156 is arranged above the float device 26.

The second float device 158 is provided with a second float 158*a* that is moved according to the water level in the small tank 156 and an L-shaped rod member 158*b* fixed to the bottom surface of the second float 158*a*.

The second float 158*a* is a hollow rectangular parallelepiped member and is configured to move in the vertical direction in conjunction with the water level of flush water stored in the small tank 156.

The proximal end of the L-shaped rod member 158*b* is fixed to the bottom surface of the second float 158*a*, and is formed in an L shape that is configured with a portion passing through the discharge hole 156*b* of the small tank 156 and extending vertically downward, a bending portion that is bent toward the float device 26 arranged in the storage tank 10 outside the small tank 156, and a portion extending to a distal end portion arranged near the bottom surface of the float 26*a* of the float device 26.

Figure 17A:
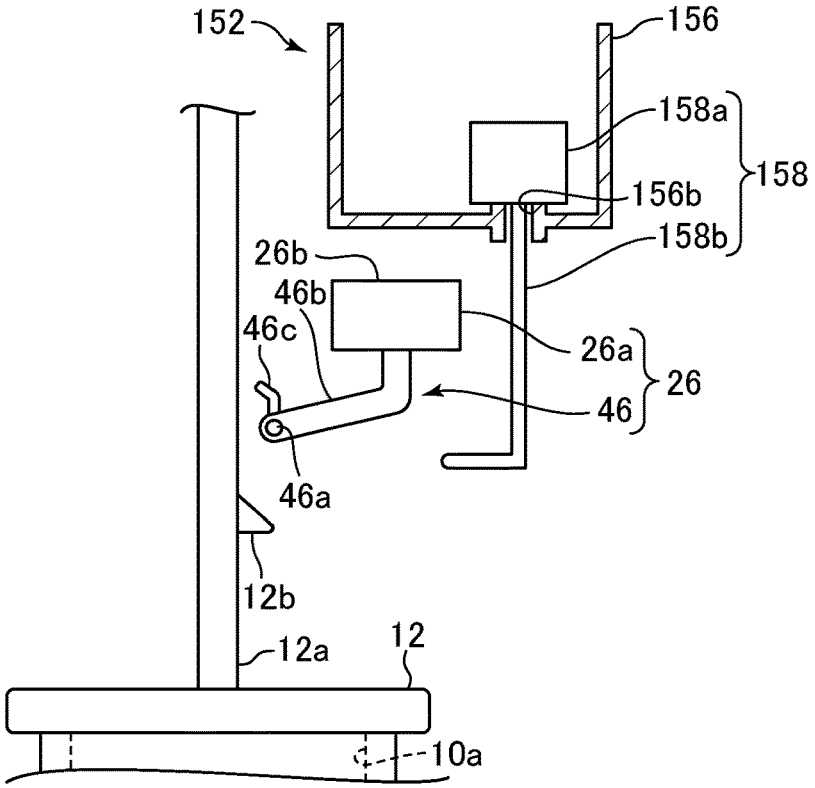
FIG. 17A is a diagram enlargingly showing a portion of a discharge valve and a float device provided for the flush water tank apparatus according to the second embodiment of the present invention.
Figure 17B:
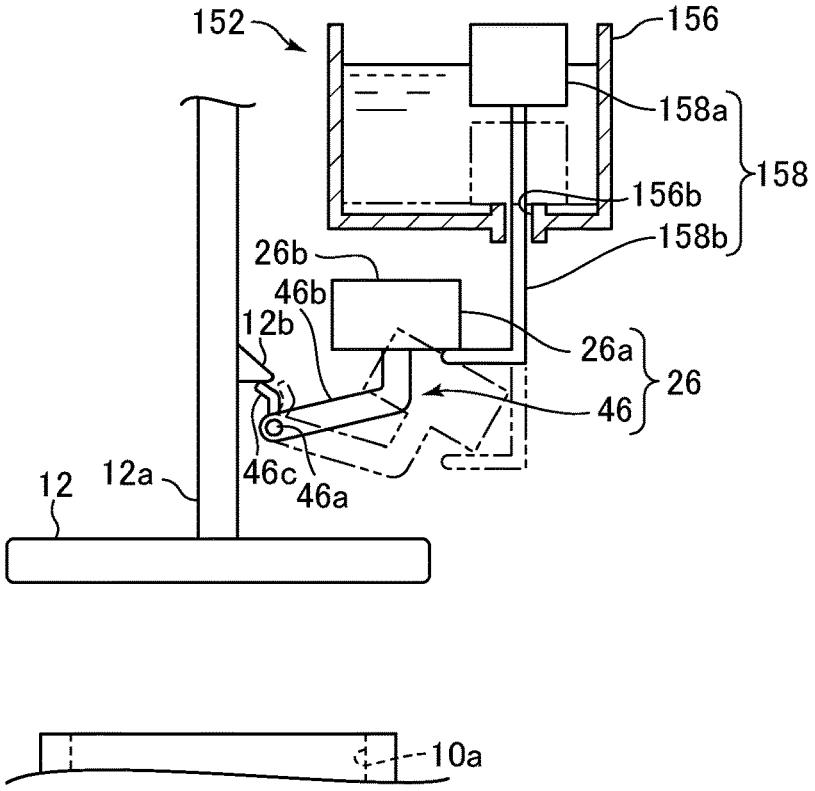
FIG. 17B is a diagram enlargingly showing a portion of a discharge valve and a float device provided for the flush water tank apparatus according to the second embodiment of the present invention.

As shown in FIG. 17A, when the small tank 156 is in a standby state (a state in which flush water is not stored in the small tank 156), the distal end portion of the L-shaped rod member 158*b* has descended to a position of not being in contact with the float 26*a*. On the other hand, as shown in FIG. 17B, in a state in which a predetermined amount of flush water or more is stored in the small tank 156, the distal end portion of the L-shaped rod member 158*b* ascends to a position of being in contact with the lower surface of the float 26*a*. In this case, even if the water level in the storage tank 10 is low, the float 26*a* of the float device 26 is pulled up according to the water level in the small tank 156.

When the large washing is selected by the remote controller 6 or the like, the small tank device 152 acts so that the timing of the discharge valve 12 descending and the drain port 10*a* being blocked is later than the case of the small washing being selected. In other words, the small tank device 152 is configured to, even after the water level in the storage tank 10 drops below a predetermined water level, keep the holding mechanism 46 of the float device 26 arranged in the storage tank 10 in the holding state. More specifically, by using buoyancy of the second float device 158 arranged in the small tank 156 to cause the float 26*a* of the float device 26 not to descend, by the L-shaped rod member 158*b* of the second float device 158 even after the water level in the storage tank 10 drops below the predetermined water level, it is possible to keep the holding mechanism 46 in the holding state. Thereby, the timing of causing the discharge valve 12 to descend is controlled. Note that, in the present embodiment, the amount of flush water discharged when the small washing is selected corresponds to the first amount of flush water, and the amount of flush water discharged when the large washing is selected corresponds to the second amount of flush water.

Next, a description will be made on operation of the flush water tank apparatus 104 according to the second embodiment of the present invention and operation of a flush toilet apparatus 100 provided with the flush water tank apparatus 104 with reference to FIGS. 16 to 26.

First, in the toilet washing standby state shown in FIG. 16, the water level in the storage tank 10 is the predetermined full water level WL. In this state, both of the first control valve 16 and the second control valve 22 are closed. The holding mechanism 46 is in the holding state shown by solid lines in FIG. 17A. Next, when the user pushes the large washing button on the remote controller 6, the remote controller 6 transmits an instruction signal for executing the large washing mode to the controller 40. When the small washing button is pushed, an instruction signal for executing the small washing mode is transmitted to the controller 40. Thus, in the present embodiment, the flush toilet apparatus 1 is provided with the two washing modes, the large washing mode and the small washing mode with different amounts of flush water, and the remote controller 6 functions as the flush water amount selection device for selecting the amount of flush water. The flush toilet apparatus 100 is provided with the plurality of washing modes with different amounts of flush water.

Next, operation of the small washing mode according to the second embodiment will be described with reference to FIGS. 16 to 22.

As shown in FIG. 16, the toilet washing standby state is similar to that of the first embodiment.

When receiving an instruction signal to perform small washing, the controller 40 causes the solenoid valve 18 provided for the first control valve 16 to operate to open the first control valve 16. The controller 40 leaves the second control valve 22 closed.

Figure 18:
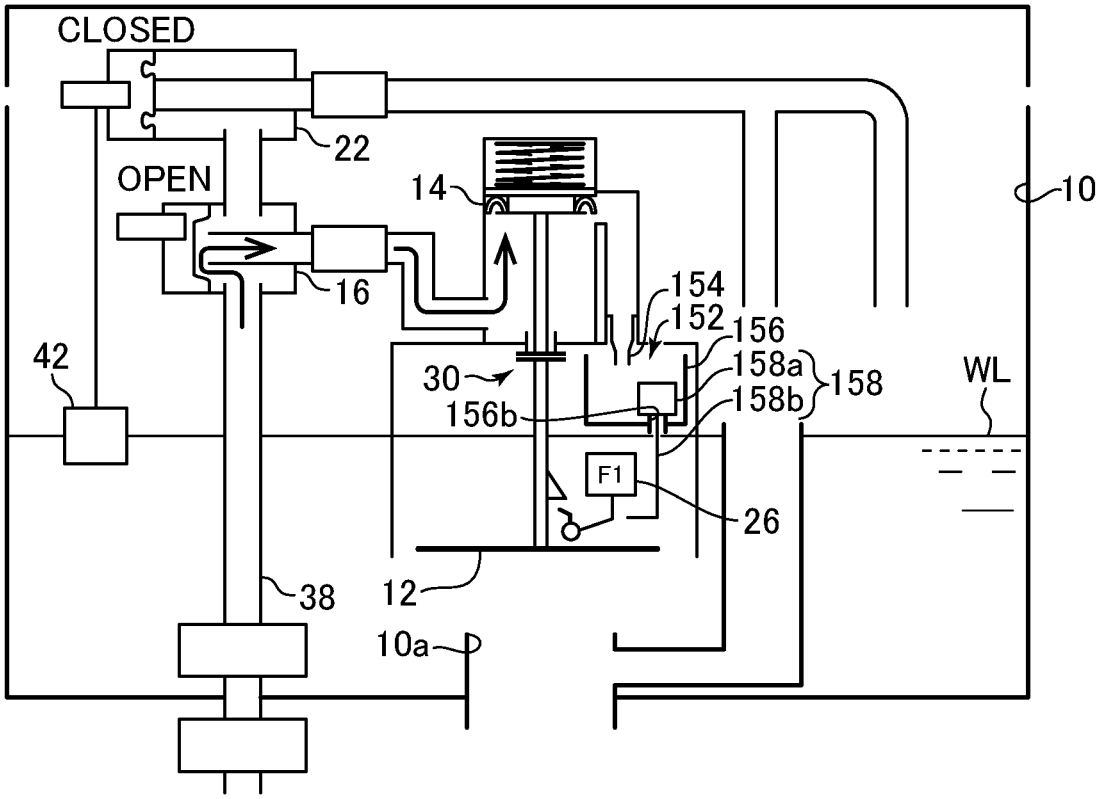
FIG. 18 is a diagram showing operation in a small washing mode of the flush water tank apparatus according to the second embodiment of the present invention.

When the first control valve 16 is opened, flush water flowing in from the water supply pipe 38 is supplied to the discharge valve hydraulic drive unit 14 via the first control valve 16 as shown in FIG. 18. Thereby, the piston 14*b* of the discharge valve hydraulic drive unit 14 is pushed up; the discharge valve 12 is pulled up via the rod 32; and flush water in the storage tank 10 is discharged from the drain port 10*a* to the flush toilet main body 2.

Figure 19:
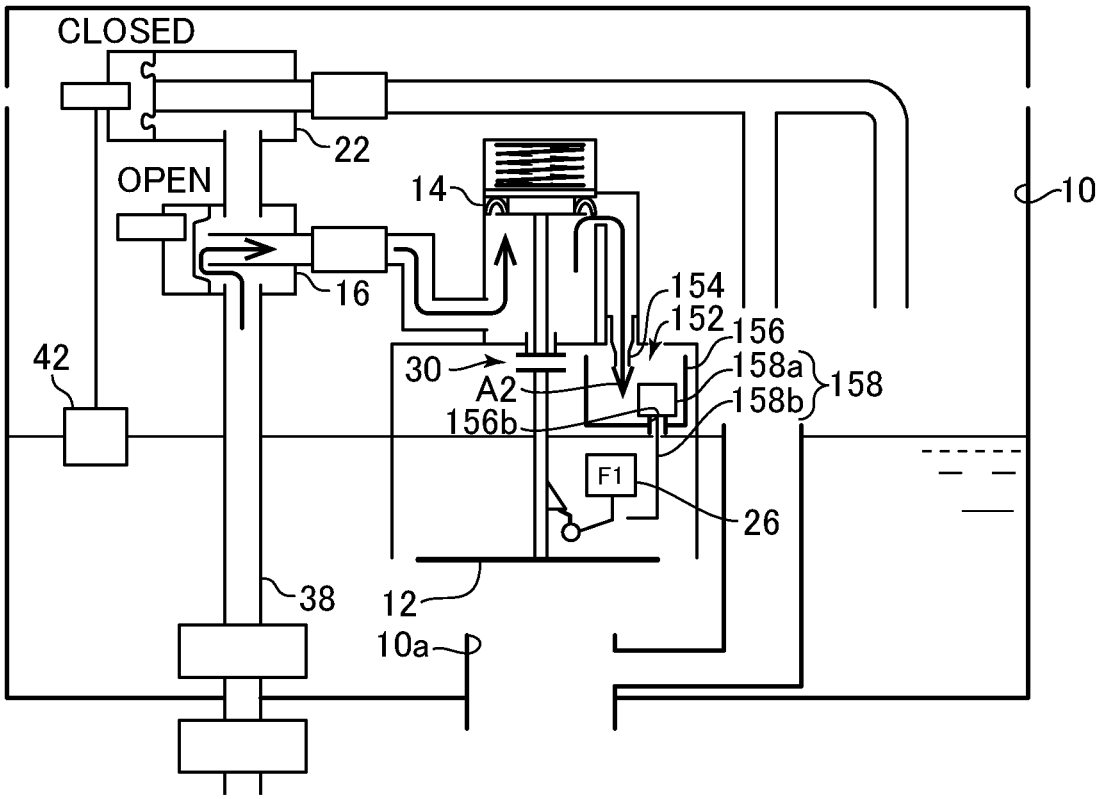
FIG. 19 is a diagram showing the operation in the small washing mode of the flush water tank apparatus according to the second embodiment of the present invention.

Next, when the discharge valve 12 is further pulled up, the clutch mechanism 30 is disconnected as shown in FIG. 19. When the clutch mechanism 30 is disconnected, the discharge valve 12 starts to descend toward the drain port 10*a* due to its own weight. Here, since the water level in the storage tank 10 is high immediately after the discharge valve 12 is opened, the holding mechanism 46 is in the holding state shown by solid lines in FIG. 17B. Therefore, the discharge valve 12 is held at a predetermined height by the holding mechanism 46. By the discharge valve 12 being held by the holding mechanism 46, the drain port 10*a* is kept in the open state, and discharge of flush water in the storage tank 10 to the flush toilet main body 2 is kept. At this time, the pilot valve 16*d* is still in the open state, and flush water flowing in from the water supply pipe 38 is supplied to the discharge valve hydraulic drive unit 14 via the first control valve 16. Thereby, the piston 14*b* is raised to the second position, and the drive unit water supply passage 34*a* and the drive unit discharge passage 34*b* are caused to communicate with each other via the inside of the cylinder 14*a*, so that flush water is supplied to the small tank device 152.

Figure 20:
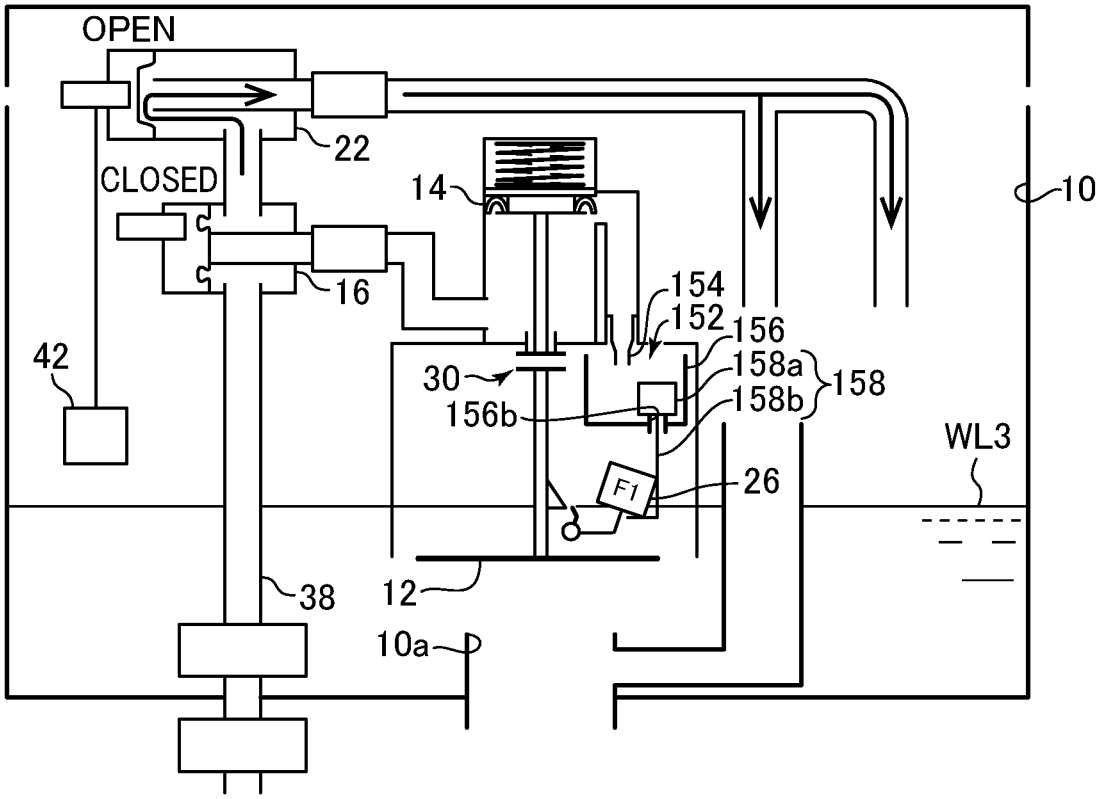
FIG. 20 is a diagram showing the operation in the small washing mode of the flush water tank apparatus according to the second embodiment of the present invention.

Then, when the water level in the storage tank 10 drops as shown in FIG. 20, the float switch 42 that detects the water level in the storage tank 10 is turned off. When the float switch 42 is turned off, the pilot valve 22*c* provided for the second control valve 22 is opened. Thereby, flush water is supplied from the second control valve 22 into the storage tank 10 via the water supply passage 50. When the small washing mode is selected, the controller 40 causes the solenoid valve 18 to operate in a relatively short time to close the pilot valve 16*d* of the first control valve 16. The main valve body 16*a* of the first control valve 16 is closed by the pilot valve 16*d* being closed. Even after the pilot valve 16*d* is closed, the open state of the second control valve 22 is kept, and water supply to the storage tank 10 is continued.

By the first control valve 16 being closed, supply of flush water to the discharge valve hydraulic drive unit 14 and the small tank device 152 is stopped. When the small washing mode is executed, since the time from the first control valve 16 being opened until being closed is a relatively short time, the amount of flush water flowing into the small tank 156 is small. Therefore, the water level of flush water stored in the small tank 156 does not rise enough for the distal end portion of the L-shaped rod member 158*b* of the second float device 158 to come into contact with the lower surface of the float 26*a* of the float device 26 in the storage tank 10.

Then, as shown in FIG. 20, when the water level in the storage tank 10 drops to a predetermined water level WL3, the position of the float 26*a* connected to the holding mechanism 46 descends. Thereby, the holding mechanism 46 is switched to the non-holding state shown by the imaginary lines in FIG. 17B. By the holding mechanism 46 being switched to the non-holding state, the discharge valve 12 leaves from the holding mechanism 46 and starts to descend again.

Figure 21:
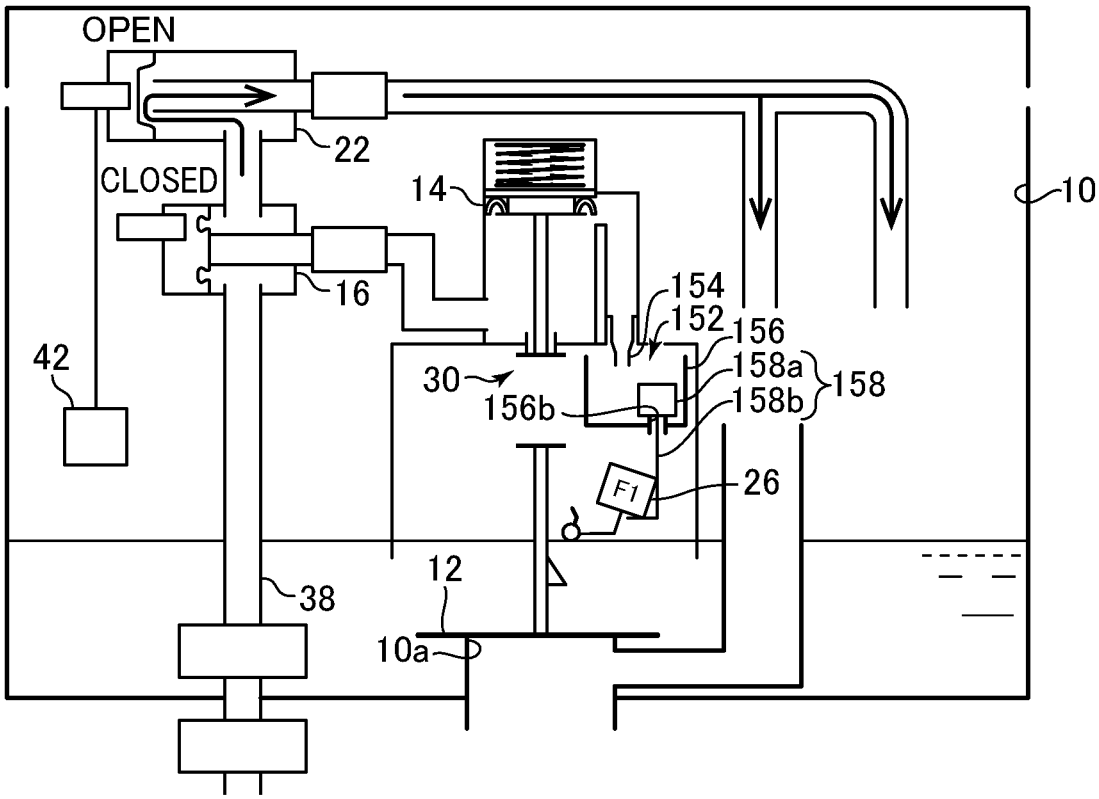
FIG. 21 is a diagram showing the operation in the small washing mode of the flush water tank apparatus according to the second embodiment of the present invention.

Thereby, the discharge valve 12 seats on the drain port 10*a*, and the drain port 10*a* is blocked as shown in FIG. 21. Thus, when the small washing mode is executed, the discharge valve 12 is held until the water level in the storage tank 10 drops from the full water level WL to the predetermined water level WL3, and the first amount of flush water is discharged to the flush toilet main body 2.

Since the float switch 42 is still in the off state, the open state of the second control valve 22 is kept, and water supply to the storage tank 10 is continued. Flush water supplied via the water supply passage 50 reaches the water supply passage branch portion 50*a*, and a part of the flush water branched at the water supply passage branch portion 50*a* flows into the overflow pipe 10*b*, and the remaining flush water is stored in the storage tank 10. The flush water flowing into the overflow pipe 10*b* flows into the flush toilet main body 2 and is used to refill the bowl 2*a*. By flush water flowing into the storage tank 10 in the state of the discharge valve 12 being closed, the water level in the storage tank 10 rises.

Figure 22:
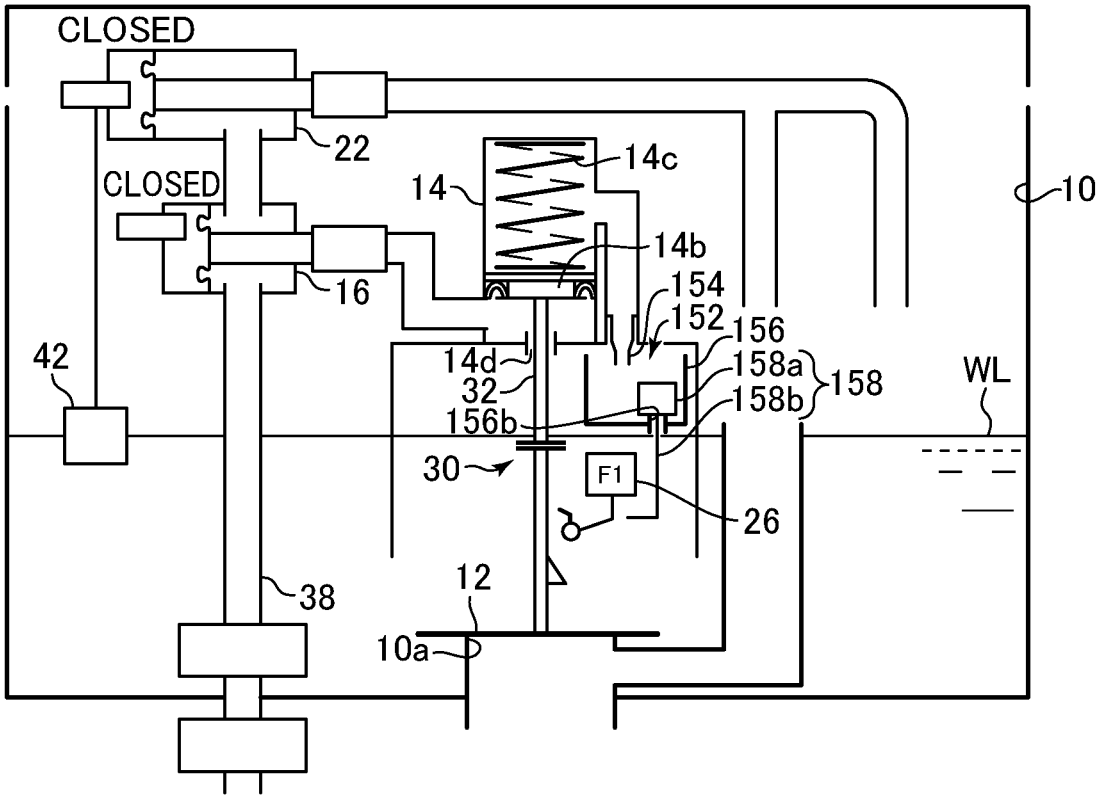
FIG. 22 is a diagram showing the operation in the small washing mode of the flush water tank apparatus according to the second embodiment of the present invention.

When the water level in the storage tank 10 rises to the full water level WL as shown in FIG. 22, the float switch 42 is turned on. When the float switch 42 is turned on, the pilot valve 22*c* on the float switch side is closed. Thereby, the pilot valve 22*c* enters the closed state. Therefore, the pressure in the pressure chamber 22*b* rises, the main valve body 22*a* of the second control valve 22 is closed, and water supply is stopped.

After the first control valve 16 is closed, and water supply to the discharge valve hydraulic drive unit 14 is stopped, flush water in the cylinder 14*a* of the discharge valve hydraulic drive unit 14 gradually flows out from the gap 14*d*, and the piston 14*b* is pushed down by the energizing force of the spring 14*c*. Accompanying this, the rod 32 descends. Thereby, the clutch mechanism 30 is connected, and the standby state before toilet washing being started is returned to.

Next, a description will be made on operation of the large washing mode by the flush water tank apparatus 104 of the second embodiment of the present invention with reference to FIG. 16, and FIGS. 23 to 26.

As shown in FIG. 16, the toilet washing standby state is similar to that of the small washing.

When receiving an instruction signal to perform large washing, the controller 40 causes the solenoid valve 18 provided for the first control valve 16 to operate to open the first control valve 16. The controller 40 leaves the second control valve 22 closed.

Figure 23:
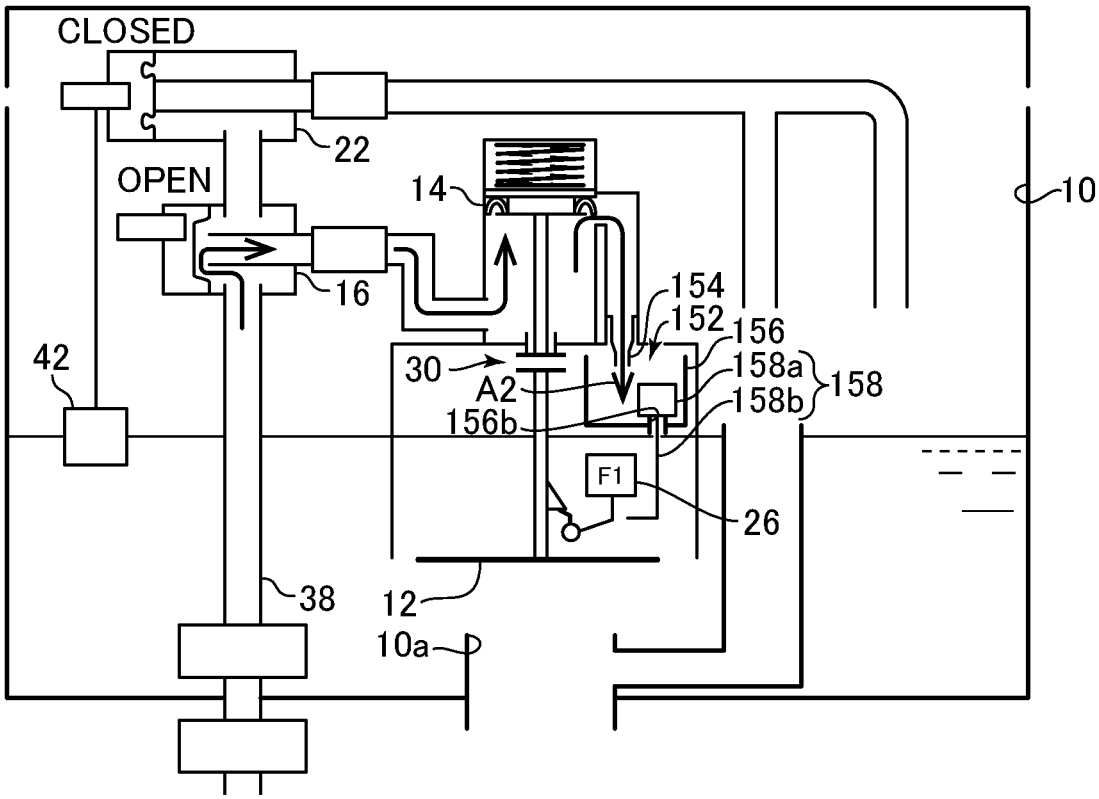
FIG. 23 is a diagram showing operation in a large washing mode of the flush water tank apparatus according to the second embodiment of the present invention.

As shown in FIG. 23, the process until the discharge valve 12 is held at a predetermined height by the holding mechanism 46 after the clutch mechanism 30 is disconnected is similar to that of the small washing mode.

Figure 24:
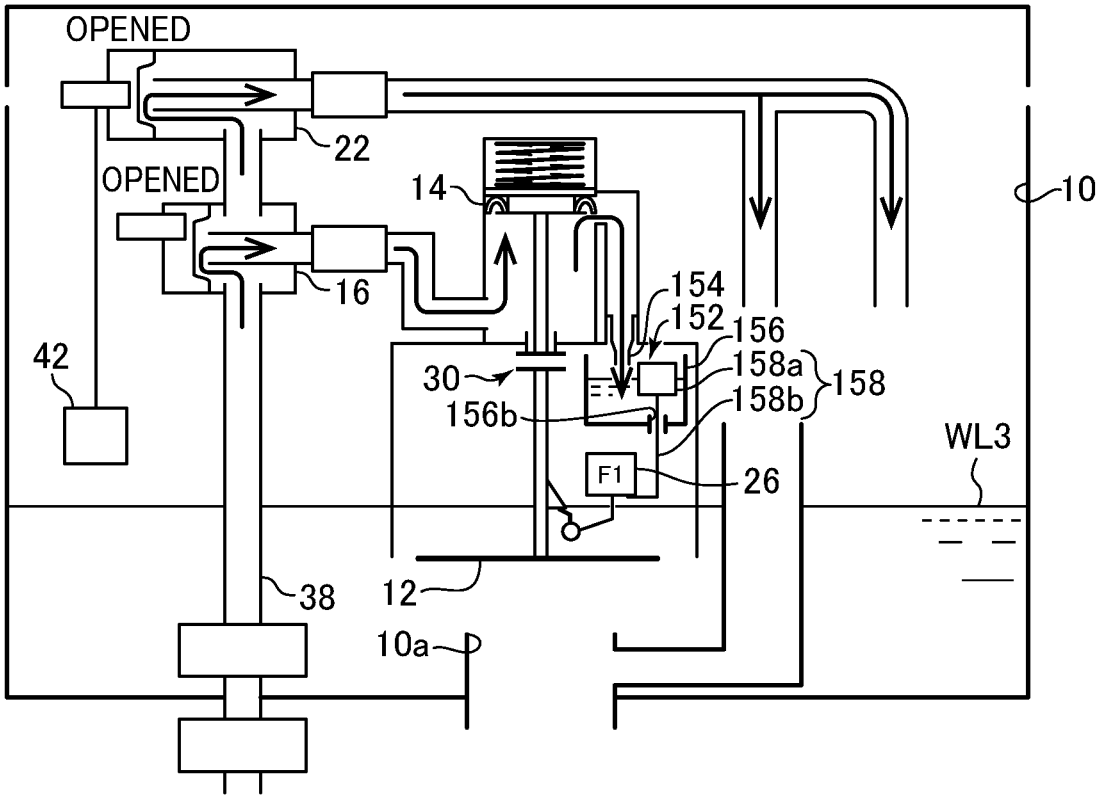
FIG. 24 is a diagram showing the operation in the large washing mode of the flush water tank apparatus according to the second embodiment of the present invention.

Then, when the water level in the storage tank 10 drops as shown in FIG. 24, the float switch 42 that detects the water level in the storage tank 10 is turned off. When the float switch 42 is turned off, the pilot valve 22*c* provided for the second control valve 22 is opened. Thereby, flush water is supplied from the second control valve 22 into the storage tank 10 via the water supply passage 50. When the large washing mode is selected, the controller 40 keeps the pilot valve 16*d* of the first control valve 16 open for a relatively long time. Thereby, flush water flowing in from the water supply pipe 38 is discharged to the small tank 156 from the discharge unit 154 via the first control valve 16 and the discharge valve hydraulic drive unit 14 for a relatively long time.

The flush water discharged from the discharge unit 154 flows into the small tank 156. Flush water in the small tank 156 is discharged outside the small tank 156 (in the storage tank 10) from the discharge hole 156*b* little by little. In other words, an instantaneous flow rate A1 of the flush water discharged from the discharge hole 156*b* is smaller than an instantaneous flow rate A2 of the flush water discharged from the discharge unit 154. Therefore, the water level of the flush water stored in the small tank 156 rises. Accompanying the rise of the water level of the flush water stored in the small tank 156, the second float 158*a* of the second float device 158 ascends. Thereby, the distal end portion of the L-shaped rod member 158*b* of the second float device 158 comes into contact with the lower surface of the float 26*a* of the float device 26 in the storage tank 10. By the float 26*a* being supported from below by the L-shaped rod member 158*b*, the holding mechanism 46 is kept in the holding state even after the water level in the storage tank 10 drops below the predetermined water level.

After causing the solenoid valve 18 to open, the controller 40 closes the solenoid valve 18 after a predetermined time passes. The predetermined time is set, for example, so that the second amount of flush water can be discharged. After the predetermined passes, the first control valve 16 is closed, and discharge of flush water from the discharge unit 154 to the small tank 156 is stopped. Flush water stored in the small tank 156 is gradually discharged from the discharge hole 156*b*. Accompanying drop of the water level of the flush water stored in the small tank 156, the second float 158*a* descends to the position of the standby state again. Thereby, the L-shaped rod member 158*b* of the second float device 158 descends to the position of not being in contact with the lower surface of the float 26*a*. Accompanying this, the float 26*a* also descends, and the holding mechanism 46 is switched to the non-holding state. When the holding mechanism 46 is switched to the non-holding state, the discharge valve 12 leaves from the holding mechanism 46 and starts to descend again.

Figure 25:
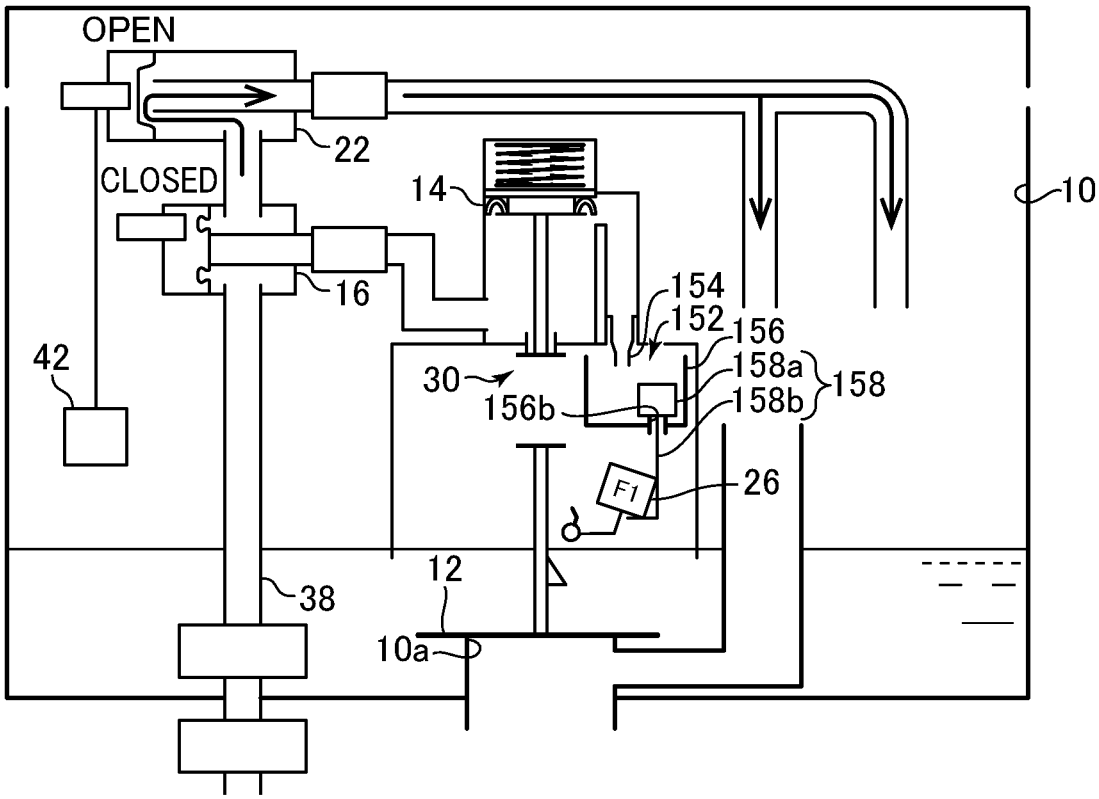
FIG. 25 is a diagram showing the operation in the large washing mode of the flush water tank apparatus according to the second embodiment of the present invention.

Thereby, the discharge valve 12 seats on the drain port 10*a*, and the drain port 10*a* is blocked as shown in FIG. 25. After the drain port 10*a* is blocked, the float switch 42 is still in the off state, and, therefore, the open state of the second control valve 22 is kept, water supply to the storage tank 10 is continued, and the water level in the storage tank 10 rises again.

Figure 26:
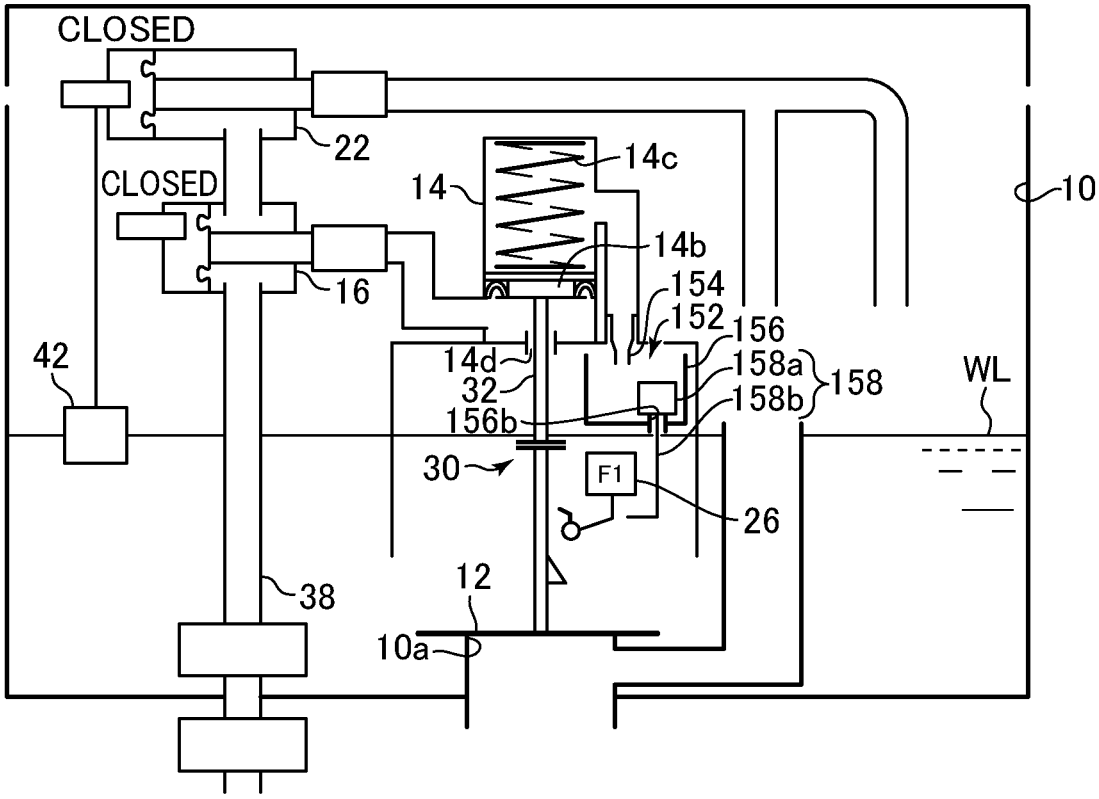
FIG. 26 is a diagram showing the operation in the large washing mode of the flush water tank apparatus according to the second embodiment of the present invention.

When the water level in the storage tank 10 rises to the full water level WL as shown in FIG. 26, the float switch 42 is turned on. When the float switch 42 is turned on, the pilot valve 22*c* on the float switch side is closed. Thereby, the pilot valve 22*c* enters the closed state. Therefore, the pressure in the pressure chamber 22*b* rises, the main valve body 22*a* of the second control valve 22 is closed, and water supply is stopped.

As shown in FIG. 26, after the first control valve 16 is closed, and water supply to the discharge valve hydraulic drive unit 14 is stopped, flush water in the cylinder 14*a* of the discharge valve hydraulic drive unit 14 gradually flows out from the gap 14*d*, and the piston 14*b* is pushed down by the energizing force of the spring 14*c*. Accompanying this, the rod 32 descends. Thereby, the clutch mechanism 30 is connected, and the standby state before toilet washing being started is returned to.

The second embodiment of the present invention has been described above. Various changes can be added to the second embodiment described above. For example, in the second embodiment described above, the float 26*a* is supported not to descend, by the L-shaped rod member 158*b* of the second float device 158 arranged in the small tank 156. Thereby, the holding mechanism 46 of the float device 26 is kept in the holding state regardless of the water level in the storage tank 10. In comparison, as a modification, the present invention can be configured so that, by arranging the float 26*a* of the float device 26 in the small tank 156, the holding mechanism 46 arranged outside the small tank 156 operates in conjunction with movement of the float 26*a* in the small tank 156.

In this modification, the float 26*a* of the float device 26 is moved according to the water level in the small tank 156, and the holding mechanism 46 is switched between the holding state and the non-holding state. When the holding mechanism 46 is in the holding state, the discharge valve 12 is held at a predetermined height. Further, in this modification, the bottom surface of the small tank 156 is arranged below the stopped water level (the full water level WL) of the water storage tank 10, and a small hole is made in a lower part of the small tank 156. Thereby, when flush water is not supplied into the small tank 156, the water level in the small tank 156 is equal to the water level in the storage tank 10. On the other hand, when flush water is supplied into the small tank 156, the water level in the small tank 156 rises irrespective of the water level in the storage tank 10. Accompanying this, the float 26*a* in the small tank 156 rises, and the holding mechanism 46 is switched to the holding state.

In this modification, when the small washing mode is selected, only a small amount of flush water is supplied into the small tank 156, and, thereby, the water level in the small tank 156 is almost the same as the water level in the storage tank 10. Therefore, when the water level in the storage tank 10 drops to the water level WL3 after washing is started, the holding mechanism 46 is switched to the non-holding state in conjunction with the float 26*a* in the small tank 156, and the discharge valve 12 descends. Thus, the discharge valve 12 is caused to descend at the timing of the water level in the storage tank 10 dropping to the predetermined water level WL3, which is the original descent timing of the float 26*a*, and the small washing mode is achieved.

When the large washing mode is selected, the controller 40 causes the first control valve 16 to be open until the predetermined time during which the second amount of flush water can be discharged passes and keeps supplying flush water into the small tank 156. Thereby, the water level in the small tank 156 becomes higher than the water level in the storage tank 10, and the holding mechanism 46 is kept in the holding state even after the water level in the storage tank 10 drops to the predetermined water level WL3 or below. Then, the first control valve 16 is opened when the predetermined time during which the second amount of flush water can be discharged has passed to cause the water level in the small tank 156 to drop. Accompanying this, the float 26*a* also descends, and the holding mechanism 46 is switched to the non-holding state. Thereby, the discharge valve 12 is held even after the water level in the storage tank 10 drops below the predetermined water level WL3, which is the original descent timing of the float 26*a*, and the large washing mode can be executed.

REFERENCE SIGNS LIST

1 flush toilet apparatus
2 flush toilet main body
4 flush water tank apparatus
10 storage tank
10*a* drain port
12 discharge valve
14 discharge valve hydraulic drive unit
14*a* cylinder
14*b* piston
16 first control valve
22 second control valve
26*a* float
30 clutch mechanism
32 rod
54 discharge unit
56 water storage unit
56*a* upper end
56*b* discharge hole
56*c* side wall
104 flush water tank apparatus
156 small tank
156*b* discharge hole
A1 instantaneous flow rate
A2 instantaneous flow rate
WL full water level
WL1 predetermined water level
WL2 predetermined water level
WL3 predetermined water level

What is claimed is:

1. A flush water tank apparatus for supplying flush water to a flush toilet, the flush water tank apparatus comprising:

a storage tank storing flush water to be supplied to the flush toilet, with a drain port for discharging the stored flush water to the flush toilet formed therein;

a discharge valve opening/closing the drain port and performing supply/stop of the flush water to the flush toilet;

a discharge valve hydraulic drive unit driving the discharge valve using water supply pressure of supplied tap water;

a clutch mechanism coupling the discharge valve and the discharge valve hydraulic drive unit to pull up the discharge valve by driving force of the discharge valve hydraulic drive unit, and being disconnected at a predetermined timing to cause the discharge valve to descend;

a flush water amount selection device capable of selecting between a first amount of flush water for washing the flush toilet and a second amount of flush water smaller than the first amount of flush water; and a timing control mechanism controlling, when the second amount of flush water is selected by the flush water amount selection device, a timing of causing the discharge valve to descend so that a timing of the drain port being blocked is earlier than a case of the first amount of flush water being selected.

2. The flush water tank apparatus according to claim 1, comprising a float device comprising a float moved according to a water level in the storage tank and a holding mechanism switchable between a state of holding the discharge valve and a non-holding state in conjunction with movement of the float; wherein the holding mechanism of the float device is configured to cause a predetermined amount of flush water to be discharged, by holding the discharge valve until the water level in the storage tank drops to a predetermined water level; and the timing control mechanism is configured to, when the second amount of flush water is selected by the flush water amount selection device, switch the holding mechanism of the float device to the non-holding state before the water level in the storage tank drops to the predetermined water level to cause the second amount of flush water to be discharged or, when the first amount of flush water is selected, keep the holding mechanism in the holding state even after the water level in the storage tank drops to the predetermined water level and, after that, cause the first amount of flush water to be discharged by switching to the non-holding state.

3. The flush water tank apparatus according to claim 2, wherein, when the second amount of flush water is selected by the flush water amount selection device, the timing control mechanism switches the holding mechanism of the float device to the non-holding state before the water level in the storage tank drops to the predetermined water level.

4. The flush water tank apparatus according to claim 3, wherein, after the clutch mechanism is disconnected, the timing control mechanism switches the holding mechanism of the float device to the non-holding state before the water level in the storage tank drops to the predetermined water level.

5. The flush water tank apparatus according to claim 3, further comprising a control valve controlling supply/stop of flush water to the timing control mechanism; wherein the timing control mechanism switches the holding mechanism of the float device to the non-holding state using tap water supplied through the control valve.

6. The flush water tank apparatus according to claim 5, wherein the control valve is configured to also control supply/stop of flush water to the discharge valve hydraulic drive unit.

7. The flush water tank apparatus according to claim 6, wherein the timing control mechanism is provided on a downstream side of the discharge valve hydraulic drive unit, and flush water passing through the discharge valve hydraulic drive unit is supplied to the timing control mechanism.

8. The flush water tank apparatus according to claim 5, wherein a period of the control valve being open is changed according to an amount of flush water selected by the flush water amount selection device, and, thereby, a timing of the timing control mechanism switching the holding mechanism of the float device to the non-holding state is changed.

9. The flush water tank apparatus according to claim 8, wherein, when the second amount of flush water is selected by the flush water amount selection device, the control valve is open for a longer time than the case of the first amount of flush water being selected, and, thereby, the timing control mechanism switches the holding mechanism of the float device to the non-holding state early.

10. The flush water tank apparatus according to claim 5, wherein the control valve is opened after the clutch mechanism is disconnected, and, thereby, the tap water is supplied to the timing control mechanism.

11. The flush water tank apparatus according to claim 1, wherein the timing control mechanism comprises a discharge unit discharging supplied flush water; and when the second amount of flush water is selected by the flush water amount selection device, the timing control mechanism controls the timing of causing the discharge valve to descend, by flush water discharged from the discharge unit.

12. The flush water tank apparatus according to claim 11, wherein the timing control mechanism further comprises a water storage unit storing the flush water discharged from the discharge unit; and the timing control mechanism controls the timing of causing the discharge valve to descend, by weight of flush water stored in the water storage unit.

13. The flush water tank apparatus according to claim 12, wherein the discharge valve hydraulic drive unit comprises:

a cylinder into which supplied flush water flows;

a piston slidably arranged in the cylinder and driven by pressure of the flush water flowing into the cylinder; and a rod connected to the piston and driving the discharge valve, and a capacity of the water storage unit is smaller than a capacity of the cylinder.

14. The flush water tank apparatus according to claim 12, wherein the discharge unit of the timing control mechanism forms a downward discharge port.

15. The flush water tank apparatus according to claim 12, wherein the discharge port of the discharge unit of the timing control mechanism is arranged inside the water storage unit and at a height lower than an upper end of the water storage unit.

16. The flush water tank apparatus according to claim 12, wherein the water storage unit of the timing control mechanism is positioned above a stopped water level of the storage tank in a state of not storing flush water inside.

17. The flush water tank apparatus according to claim 16, wherein a discharge hole for discharging stored flush water is formed in the water storage unit of the timing control mechanism.

18. The flush water tank apparatus according to claim 17, wherein the discharge hole of the water storage unit is formed in a lower part of a side wall of the water storage unit and forms an opening toward an opposite side of the discharge valve in a plan view.

19. The flush water tank apparatus according to claim 17, wherein an instantaneous flow rate of flush water discharged from the discharge hole is smaller than an instantaneous flow rate of flush water discharged from the discharge unit.

20. A flush toilet apparatus comprising:

the flush water tank apparatus according to claim 1; and the flush toilet washed by flush water supplied from the flush water tank apparatus.

* * * * *